US011457745B1

(12) United States Patent
Clabots

(10) Patent No.: US 11,457,745 B1
(45) Date of Patent: Oct. 4, 2022

(54) MODULAR SEATING APPARATUS AND KIT

(71) Applicant: Burrow, Inc., New York, NY (US)

(72) Inventor: Evan Clabots, Brooklyn, NY (US)

(73) Assignee: Burrow, Inc., New York, NY (US)

( * ) Notice: Subject to any disclaimer, the term of this patent is extended or adjusted under 35 U.S.C. 154(b) by 0 days.

(21) Appl. No.: 17/319,791

(22) Filed: May 13, 2021

Related U.S. Application Data

(60) Provisional application No. 63/024,667, filed on May 14, 2020.

(51) Int. Cl.
*A47C 13/00* (2006.01)

(52) U.S. Cl.
CPC ..... *A47C 13/005* (2013.01)

(58) Field of Classification Search
CPC ..... A47C 13/005; A47C 13/00; A47C 1/124
USPC ..... 297/248
See application file for complete search history.

(56) References Cited

U.S. PATENT DOCUMENTS

| | | | |
|---|---|---|---|
| 7,213,885 | B2 | 5/2007 | White, III et al. |
| 7,419,220 | B2 | 9/2008 | White, III et al. |
| 7,547,073 | B2 | 6/2009 | White, III et al. |
| D630,450 | S | 1/2011 | Wold |
| D633,312 | S | 3/2011 | Wold |
| D633,726 | S | 3/2011 | Wold |
| D633,727 | S | 3/2011 | Wold |
| 7,963,612 | B2 | 6/2011 | Nelson |
| D697,350 | S | 1/2014 | Skalka |
| D697,351 | S | 1/2014 | Skalka |
| D697,352 | S | 1/2014 | Skalka |
| 8,714,652 | B2 | 5/2014 | Whidden et al. |
| 8,783,778 | B2 | 7/2014 | Nelson et al. |
| D743,181 | S | 11/2015 | Cardona |
| 9,277,813 | B2 | 3/2016 | Nelson et al. |
| 9,277,826 | B2 | 3/2016 | Nelson et al. |
| 9,629,466 | B2 | 4/2017 | Griggs, Jr. |
| D802,322 | S | 11/2017 | Velez |
| 9,814,314 | B2 | 11/2017 | Griggs, Jr. |
| D805,310 | S | 12/2017 | Grcic |
| D817,057 | S | 5/2018 | Kuhl et al. |
| D826,589 | S | 8/2018 | Natuzzi |
| 10,070,725 | B2 | 9/2018 | Nelson et al. |
| 10,123,621 | B2 | 11/2018 | Nelson et al. |

(Continued)

FOREIGN PATENT DOCUMENTS

| | | |
|---|---|---|
| CA | 2609450 | 2/2011 |
| CA | 2609477 | 2/2011 |

(Continued)

*Primary Examiner* — Mark R Wendell
(74) *Attorney, Agent, or Firm* — Dentons US LLP

(57) ABSTRACT

A modular seating kit for producing a modular seating apparatus, comprising one or more rectangular base platforms, at least one connecting bracket, one or more vertical supporting structures, one or more secondary vertical supporting structures, a plurality of fasteners, and one or more support legs, each base platform has a plurality of attachment points adapted to receive the support legs and fasteners, the vertical supporting structures and the secondary vertical supporting structures are adapted to be attached to one of the base platforms to function as backrests or armrests, and two or more of the base platforms are adapted to be linked together using the connecting brackets to provide the modular seating apparatus with expandable seating capacity.

20 Claims, 20 Drawing Sheets

(56) References Cited

U.S. PATENT DOCUMENTS

| | | | | |
|---|---|---|---|---|
| 10,123,623 | B2 | 11/2018 | Nelson et al. | |
| 10,143,307 | B2 | 12/2018 | Nelson et al. | |
| 10,154,733 | B2 | 12/2018 | Nelson et al. | |
| 10,182,659 | B2 | 1/2019 | Kuhl et al. | |
| 10,212,519 | B2 | 2/2019 | Nelson et al. | |
| 10,236,643 | B2 | 3/2019 | Nelson et al. | |
| 10,433,648 | B1 | 10/2019 | Kuhl et al. | |
| 10,506,883 | B2 | 12/2019 | Hirschhaut | |
| 2017/0367486 | A1 | 12/2017 | Nelson et al. | |
| 2018/0041354 | A1 | 2/2018 | Nelson et al. | |
| 2018/0352958 | A1 | 12/2018 | Griggs, Jr. | |
| 2019/0142165 | A1 | 5/2019 | Nelson et al. | |
| 2019/0222935 | A1 | 7/2019 | Nelson et al. | |
| 2020/0060423 | A1* | 2/2020 | Ferguson | F16B 12/44 |
| 2020/0187654 | A1* | 6/2020 | Mutyala | F16B 12/60 |
| 2021/0196049 | A1* | 7/2021 | McCreary | A47C 3/16 |

FOREIGN PATENT DOCUMENTS

| | | |
|---|---|---|
| CA | 2725118 | 12/2013 |
| CA | 2887664 | 4/2014 |
| CA | 3005449 | 5/2017 |
| CA | 3005456 | 5/2017 |
| CA | 30055461 | 5/2017 |
| CA | 170871 | 10/2017 |

* cited by examiner

MODULAR SEATING APPARATUS AND KIT

CROSS-REFERENCE TO RELATED APPLICATIONS

This application is a nonprovisional utility application of provisional patent application, Ser. No. 63/024,667 filed in the United States Patent Office on May 14, 2020, claims priority therefrom, and is expressly incorporated herein by reference in its entirety.

TECHNICAL FIELD

The present disclosure relates generally to the field of modular furniture. More particularly, the present disclosure relates to a modular kit for producing a seating apparatus with multiple configurations.

BACKGROUND

A conventional upholstered furniture item, such as a sofa, is typically manufactured from a frame, which is upholstered in a material such as cloth, fabric, leather or the like. This manufacture and assembly occurs at a factory unit. A volume of the completed products are then transported to consumers' premises and/or retail outlets in a common geographical area, typically as a vehicle load by road transport. For large volumes a single goods trailer can be loaded to capacity with said chairs, sofas or sofa beds for delivery to a particular geographical area with the manufacturer waiting until they have sufficient orders for units to fill the trailer to justify the economic cost of sending the trailer to that area. This waiting period can result in delays of days or weeks in the delivery of the items.

A problem with conventional sofas is that these items are relatively bulky and, therefore, can be expensive to transport. The price of sofas and similar upholstered furniture can be significantly increased by the cost of transport, e.g., taking into account related delivery services such as an overnight delivery.

A further problem often experienced by the consumer who purchases a conventional sofa or similar item of furniture from a retail outlet or a manufacturer is logistical challenges in getting the item back to their premises. The consumer may hire or borrow a trailer, van, or roof rack that is large enough to accommodate the item of furniture, or may have to pay for delivery by the supplier. Such arrangements can add cost to the purchase and can be difficult for the consumer to organize. Additionally, the consumer may have difficulty installing the furniture at a desired location without causing damage to the item and/or to the premises; for example if there is a need to remove fittings such as doors windows or the like during the installation.

One approach to addressing the drawbacks of factory assembled furniture items involves providing individually upholstered subcomponents as a ready-to-assemble ("RTA") furniture kit. The individual components can be more efficiently packed, and RTA designs allow the furniture item to be assembled in situ, eliminating the difficulties of navigating the furniture item to an installation site. However, an inherent challenge of RTA furniture kits is that the consumers who assemble the furniture kits are typically untrained and may not have ready access to the tools necessary to assemble the subcomponents. In addition, aligning the heavy subcomponents to install the fasteners for connecting the subcomponents can be difficult, particularly if a single individual is assembling the furniture item. If the fasteners are not properly installed the structural integrity of the furniture item could be compromised resulting in collapse and/or injury of users.

Therefore, a need exists for a modular furniture kit with components that can be assembled to form a multi-configuration modular furniture apparatus with minimal instruction by implementing a consistent assembly interface across all components of the kit. Furthermore, the assembly interface allows the components to be assembled in a manner which consistently maintains the structural integrity of the completed furniture apparatus, by ensuring that each component is adequately supported or reinforced.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a seating apparatus which can be assembled from a kit to suit different seating requirements. Accordingly, the present disclosure provides a modular seating kit comprising a rectangular base platform, one or more support legs, a plurality of fasteners, a vertical support structure, and a secondary vertical support structure. The base platform has four sides, an upper surface adapted to support a person seated thereon, and a lower surface with a plurality of attachment points. The attachment points allow the support legs to be attached to the lower surface of the base platform in various configurations, and are further adapted to receive and interlock with the fasteners. The vertical support structure and the secondary vertical support structure are adapted to be secured to the base platform via the fasteners. The vertical support structure is adapted to function as a backrest, while the secondary vertical support structure is adapted to function as an armrest, allowing the modular seating kit to be assembled to produce a modular seating apparatus in a configuration where the base platform includes the backrest, and another configuration where the base platform has at least one of the armrests positioned perpendicularly to the backrest.

It is another aspect of an example embodiment in the present disclosure to provide a seating apparatus which allows consistent attachment of components to each of the sides of the base platform. Accordingly, the attachment points of the base platform are arranged in colinear pairs separated by an attachment point interval distance, with one of the colinear pairs positioned along each of the four sides of the base platform, thus allowing the vertical support structure and the secondary vertical support structure to be attached to the base platform to adjoin any of the sides of the base platform.

It is yet another aspect of an example embodiment in the present disclosure to provide a seating apparatus which is expandable to seat multiple persons. Accordingly, the present disclosure provides a modular seating kit which further comprises at least one connecting bracket. Each connecting bracket has a first attachment channel and a second attachment channel, each adapted to allow one of the fasteners to pass therethrough. Each connecting bracket is adapted to link two of the base platforms placed in an adjoining arrangement, whereby the first attachment channel is aligned with one of the attachment channels of one of the adjoined base platforms, the second attachment channel is aligned with one of the attachment channels of the other adjoined base platform, and the first and second attachment channels are secured to the attachment points aligned therewith using the fasteners.

It is a further aspect of an example embodiment in the present disclosure to provide a seating apparatus which allows two adjoining base platforms to be supported by one shared support leg. Accordingly, each connecting bracket further has an inner attachment channel which is colinear with, and positioned between, the first and second attachment channels. The inner attachment channel has an interlocking means, allowing one of the support legs to be attached to one of the connecting brackets linking together two of the base platforms, thus allowing the support leg to function as a shared support leg which supports the two base platforms.

It is yet a further aspect of an example embodiment in the present disclosure to provide a seating apparatus with modular accessories and supporting surfaces. Accordingly, the modular seating kit further comprises an accessory mounting bracket and an accessory mounting member for supporting an accessory such as a lighting device, and a horizontal panel which is adapted to support small objects, the accessory mounting bracket and the horizontal panel are adapted to be attached to the lower surface of one of the base panels.

It is still a further aspect of an example embodiment in the present disclosure to provide a seating apparatus with more than one cushioning configuration. Accordingly, the present disclosure provides a modular seating kit with base platform cushions adapted to be placed on the upper surface of one of the base platforms, and at least one of the base platforms of the modular seating kit has a cushion integrated with the upper surface.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

Figure 1A:
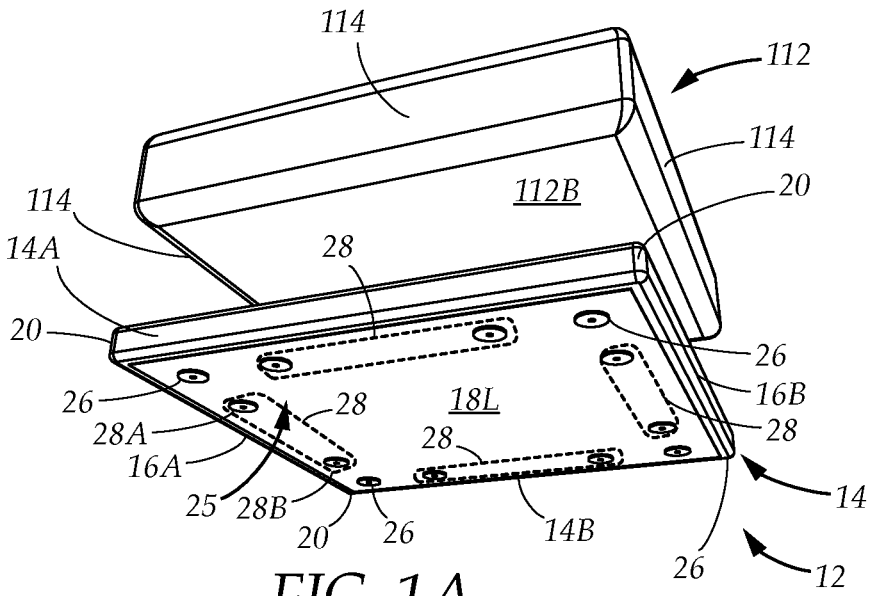
FIG. 1A is a diagrammatical perspective view of a modular base platform with a base platform cushion, in accordance with an embodiment in the present disclosure.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

FIG. 1A, FIG. 2D, FIG. 6A, and FIG. 6C illustrate a modular seating apparatus 10 which can be assembled in a variety of configurations to suit a range of seating applications. The modular seating apparatus 10 is assembled from a modular seating kit comprising a plurality of components, including at least one base platform 12, at least one support leg 104, at least one connecting bracket 30, and a plurality of fasteners 108. The modular apparatus kit further comprises at least one vertical support structure 42, and at least one secondary vertical support structure 62.

The base platforms 12 form the core components of the modular seating apparatus 10, and each base platform 12 provides a surface adapted to support a person in a sitting position. Each base platform 12 has at least one attachment point 25. The attachment points 25 are adapted to allow other components of the modular seating kit to be secured to the base platforms 12. One or more of the support legs 104 can be attached to each base platform 12 via the attachment points 25, thus allowing the base platform 12 to be supported above a horizontal surface 200 such as a floor or portion of ground. The vertical support structures 42 are likewise adapted to be secured to the base platforms 12 using the fasteners 108, and function as backrests or armrests to support the bodies of any persons seated upon the modular seating apparatus 10. Furthermore, two or more of the base platforms 12 may be linked together using connecting brackets 30 in combination with the fasteners 108, providing the assembled modular seating apparatus 10 with an expandable seating capacity.

Figure 1B:
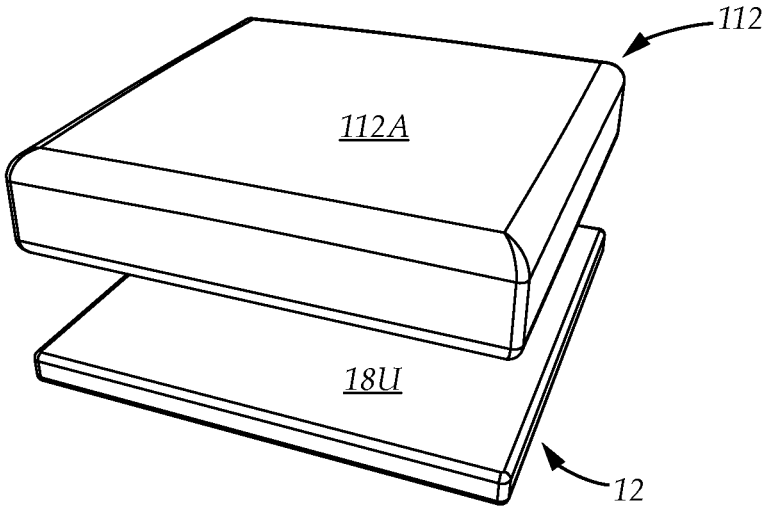
FIG. 1B is a diagrammatical perspective view of the modular base platform and the base platform cushion viewed from above, in accordance with an embodiment in the present disclosure.
Figure 1C:
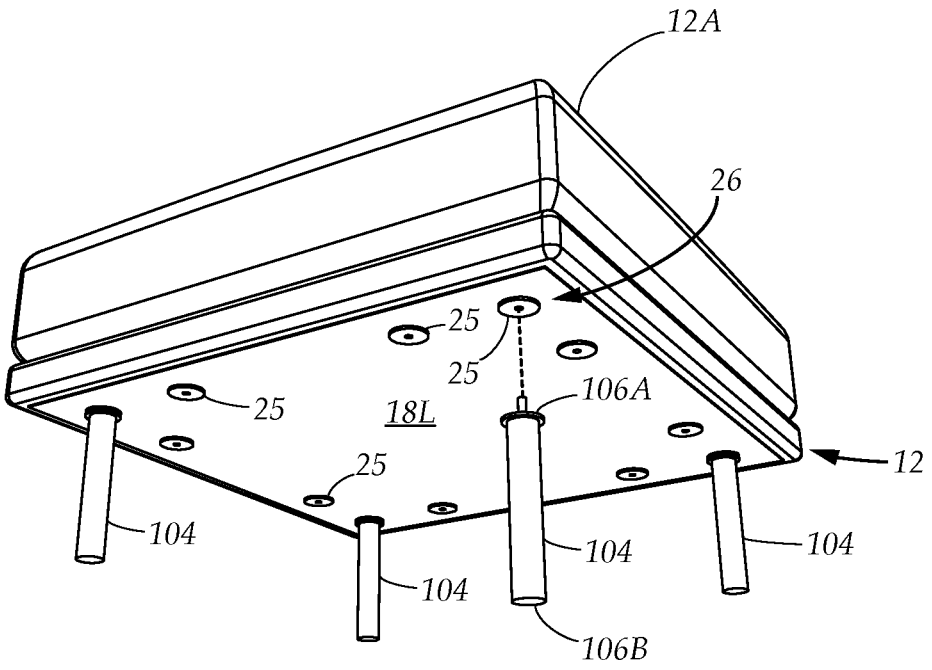
FIG. 1C a diagrammatical perspective view of the modular base platform with a plurality of attachment points and a plurality of support legs interlocked with the attachment points, in accordance with an embodiment in the present disclosure.

Referring to FIGS. 1A and 1B, in a preferred embodiment, each base platform 12 is substantially planar and has an has an upper surface 18U, a lower surface 18L, and a plurality of attachment points 25 disposed thereon. Each base platform 12 may be rectangular, having four sides. For illustrative purposes, the sides may include a first lateral side 14A, a second lateral side 14B oriented parallel thereto, and a first longitudinal side 16A and a second longitudinal side 16B extending perpendicularly between the first and second lateral sides 14A, 14B. In certain embodiments, one or more of the base platforms 12 may have sides which are all equal in length.

Figure 2A:
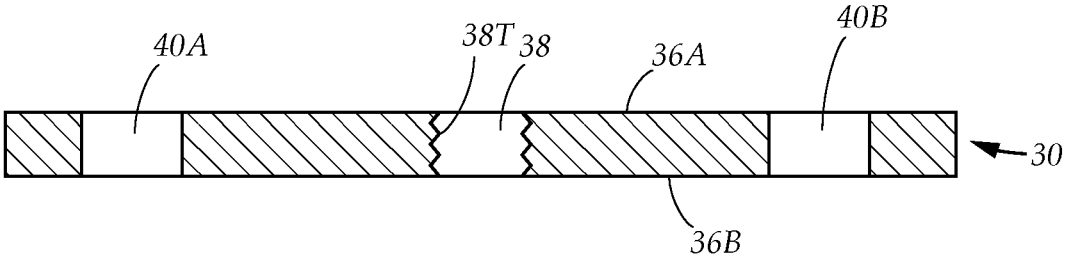
FIG. 2A is a sectional view of a connecting bracket having a first attachment channel, a threaded inner attachment channel, and a second attachment channel, in accordance with an embodiment in the present disclosure.
Figure 2B:
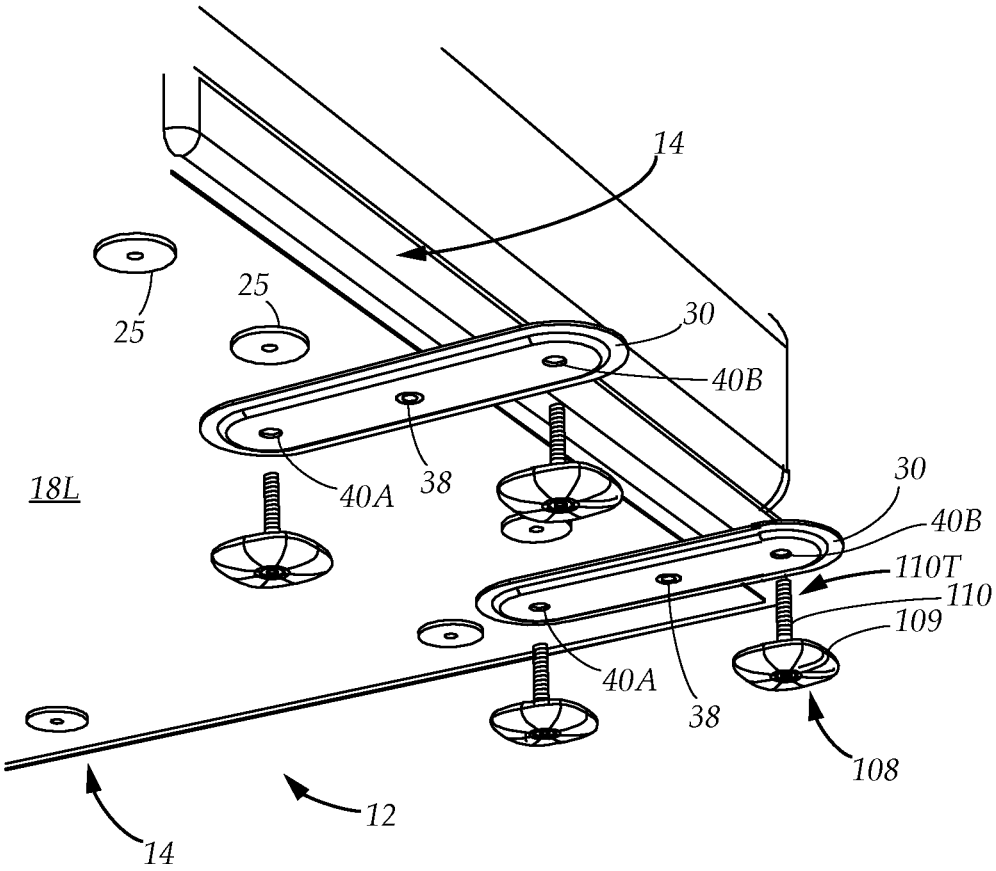
FIG. 2B is a diagrammatical perspective view of two of the connecting brackets aligned with the attachment points of the base panel, further showing a plurality of fasteners, in accordance with an embodiment in the present disclosure.
Figure 2C:
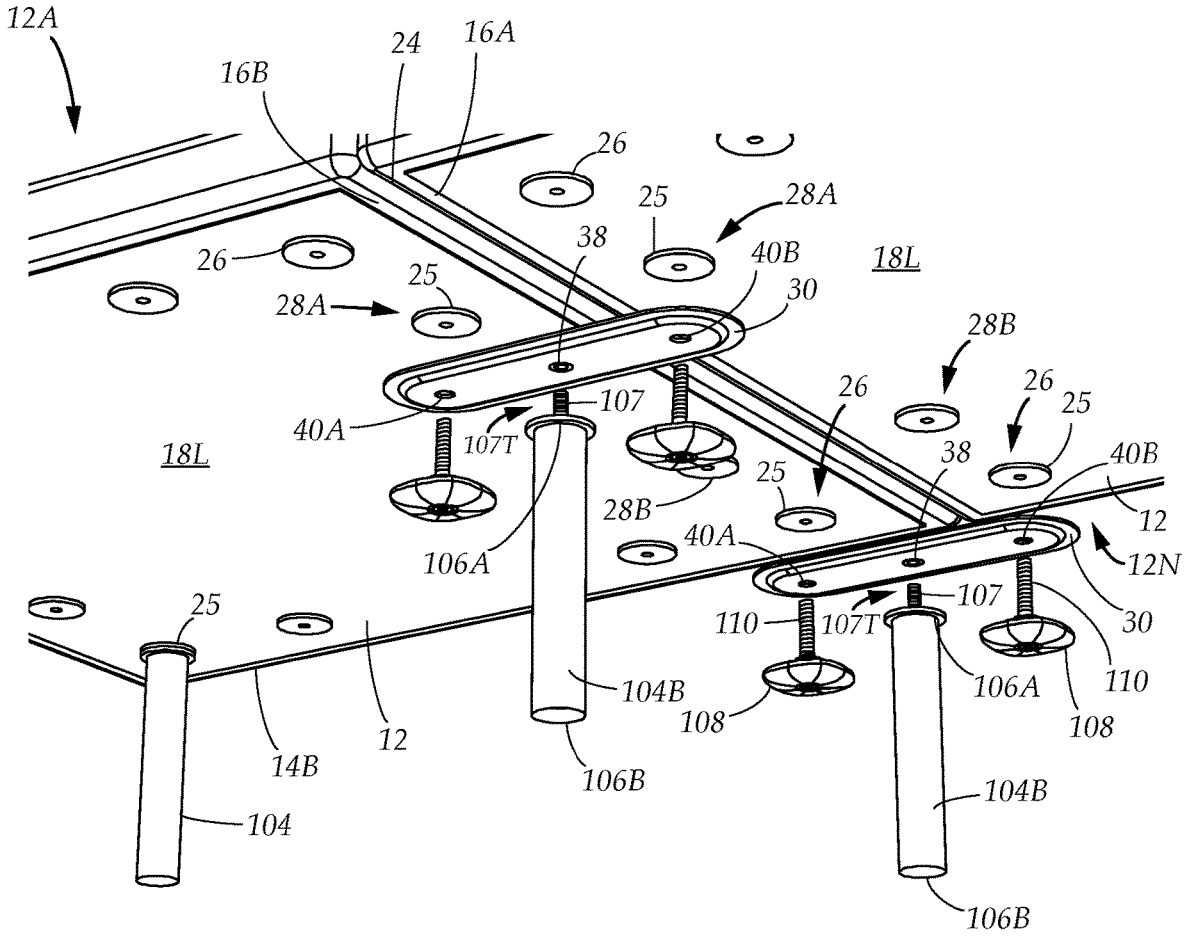
FIG. 2C is a diagrammatical perspective view of two of the connecting brackets aligned with the attachment points of two of the base platforms, further showing two shared support legs aligned with the inner attachment channels of the connecting brackets, in accordance with an embodiment in the present disclosure.
Figure 2D:
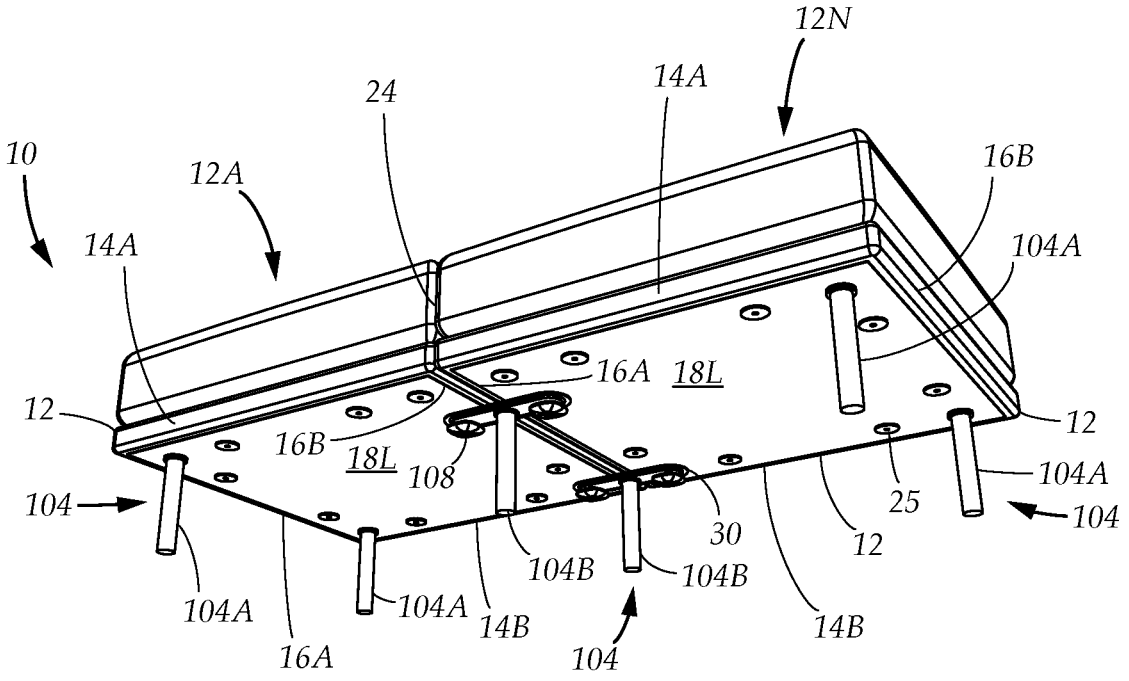
FIG. 2D is a diagrammatical perspective view of an assembled modular seating apparatus formed with two of the base platforms, in accordance with an embodiment in the present disclosure.

Referring to FIG. 1A, FIG. 10, and FIG. 2D, one or more base platforms 12 may be utilized to form the modular seating apparatus 10. The modular seating apparatus 10 may be formed from a minimum of one base platform 12. For illustrative purposes, said base platform may be referred to as a first base platform 12A, and the additional base platform 12N may be attached to each of the sides of the first base platform 12A. In one example, an additional base platform 12N may be attached to the second longitudinal side 16B of the first base platform 12A.

Figure 11:
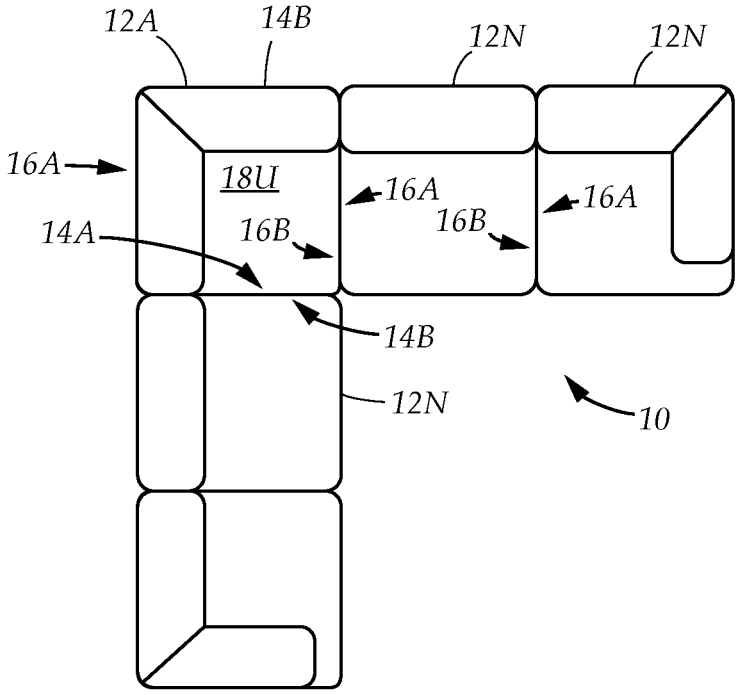
FIG. 11 is a diagrammatical top view of the modular seating apparatus, showing the base platforms linked together to form two perpendicularly oriented sequences, in accordance with an embodiment in the present disclosure.

Referring to FIG. 11 while also referring to FIG. 1A, further additional base platforms 12N may be attached directly to the additional base platform 12N adjoining the first base platform 12A to create a first linear sequence of at least three base platforms 12. In one embodiment, an additional base platform 12N may be attached to the first lateral side 14B of the first base platform 12A, thus creating a second linear sequence perpendicular to the first linear sequence. Note that this example is not intended to be limiting, and a person of ordinary skill in the art in the field of the invention will appreciate that the modular seating apparatus 10 may be assembled in many configurations in accordance with the principles of the present disclosure.

Referring to FIGS. 1A-B, in one embodiment, the base platforms 12 may be configured as substantially solid panels. A base platform cushion 112 may be placed upon the upper surface 18U of one of more of the base platforms 12 to provide comfort for the person seated thereon. Alternatively, the base platforms 12 may also be configured with integrated cushioning means. In certain embodiments, the base platforms 12 may have a cushion integrated directly into the upper surface 18U. For example, the cushion may be attached to the upper surface 18U, which is then covered with a layer of upholstery. In other embodiments, the base platforms 12 may be configured as open frames with a central void space containing webbing, sinuous springs, or other suitable cushioning means known to persons of ordinary skill in the art in the field of the invention. The base platforms 12 may formed using any material of sufficient strength, such as metal, wood, plastic, or other material as will be apparent to a person of ordinary skill in the art in the field of the invention.

Figure 1D:
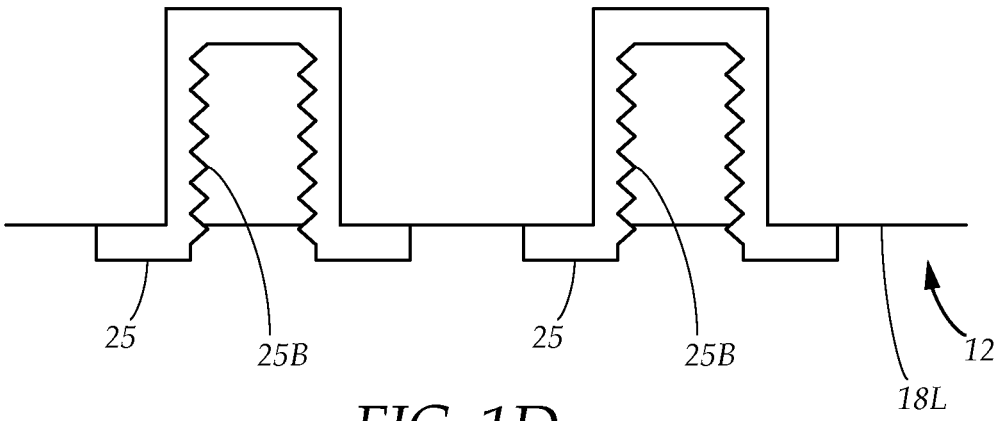
FIG. 1D is a sectional view of the attachment points showing an interlocking means, in accordance with an embodiment in the present disclosure.

Turning to FIGS. 2B-C while also referring to FIG. 1A and FIG. 1D, the attachment points 25 are adapted to allow the components of the modular seating apparatus and kit to be attached to the base platforms 12. Each of the attachment points 25 has an identical interlocking means, allowing the support legs 104 and the fasteners 109 to be attached to any of the attachment points 25. In a preferred embodiment, each attachment point 25 has as a threaded bore 25B which extends perpendicularly into the lower surface 18L of the base platforms 12. Each support leg 104 has a lower end 106B, an upper end 106A, and an attachment protrusion 107 which projects from the upper end 106A. The attachment protrusion 107 has an interlocking means adapted to interlock with the attachment point 25, allowing the support leg 104 to be securely attached to the lower surface 18L of one of the base platforms 12. In a preferred embodiment, the interlocking means comprises a threaded portion 107T which engages the threaded bore 25B.

Figure 6A:
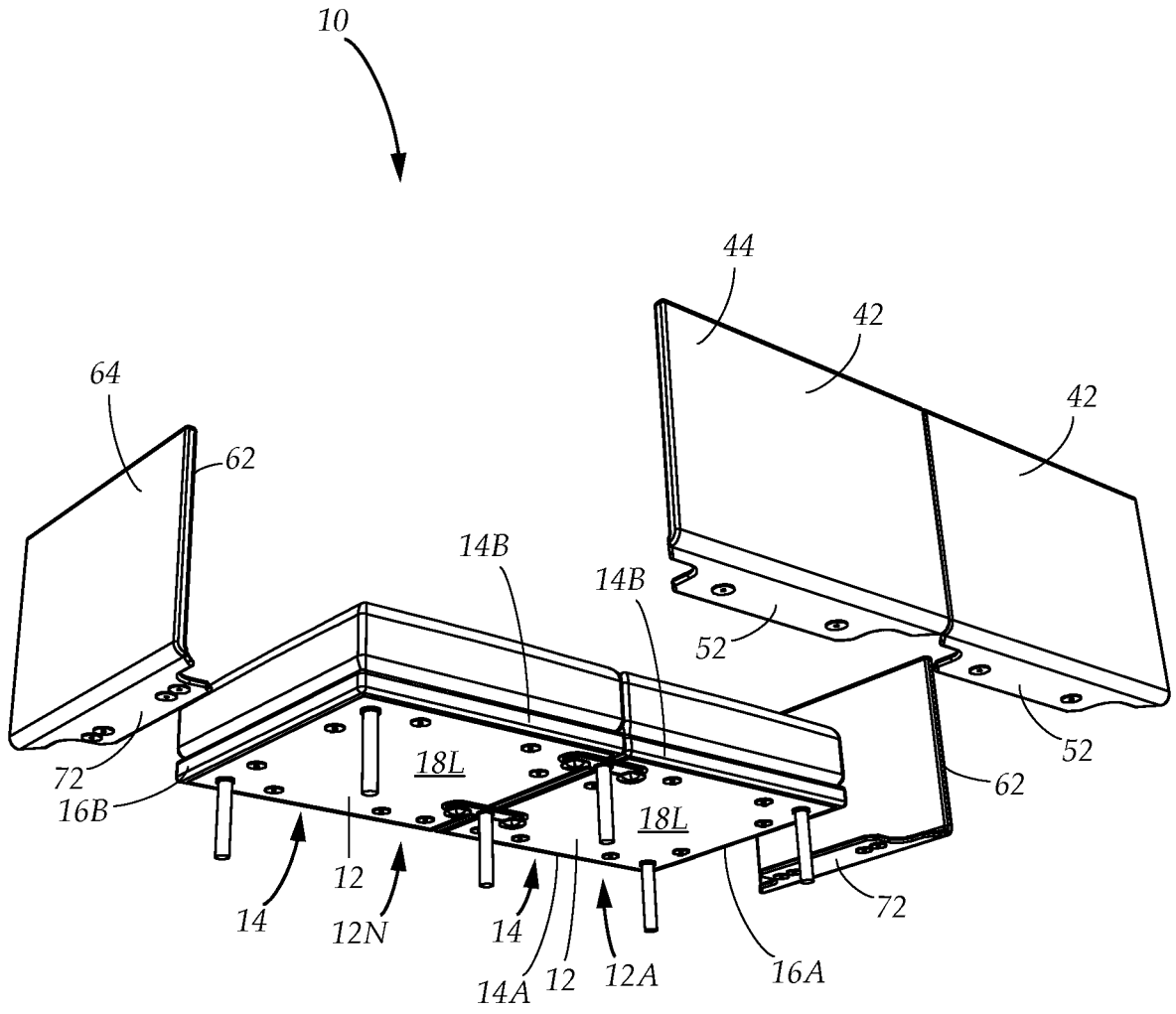
FIG. 6A is a diagrammatical exploded view showing two of the vertical support structures and two of the secondary vertical support structures, positioned for attachment to the modular seating apparatus, in accordance with an embodiment in the present disclosure.
Figure 6B:
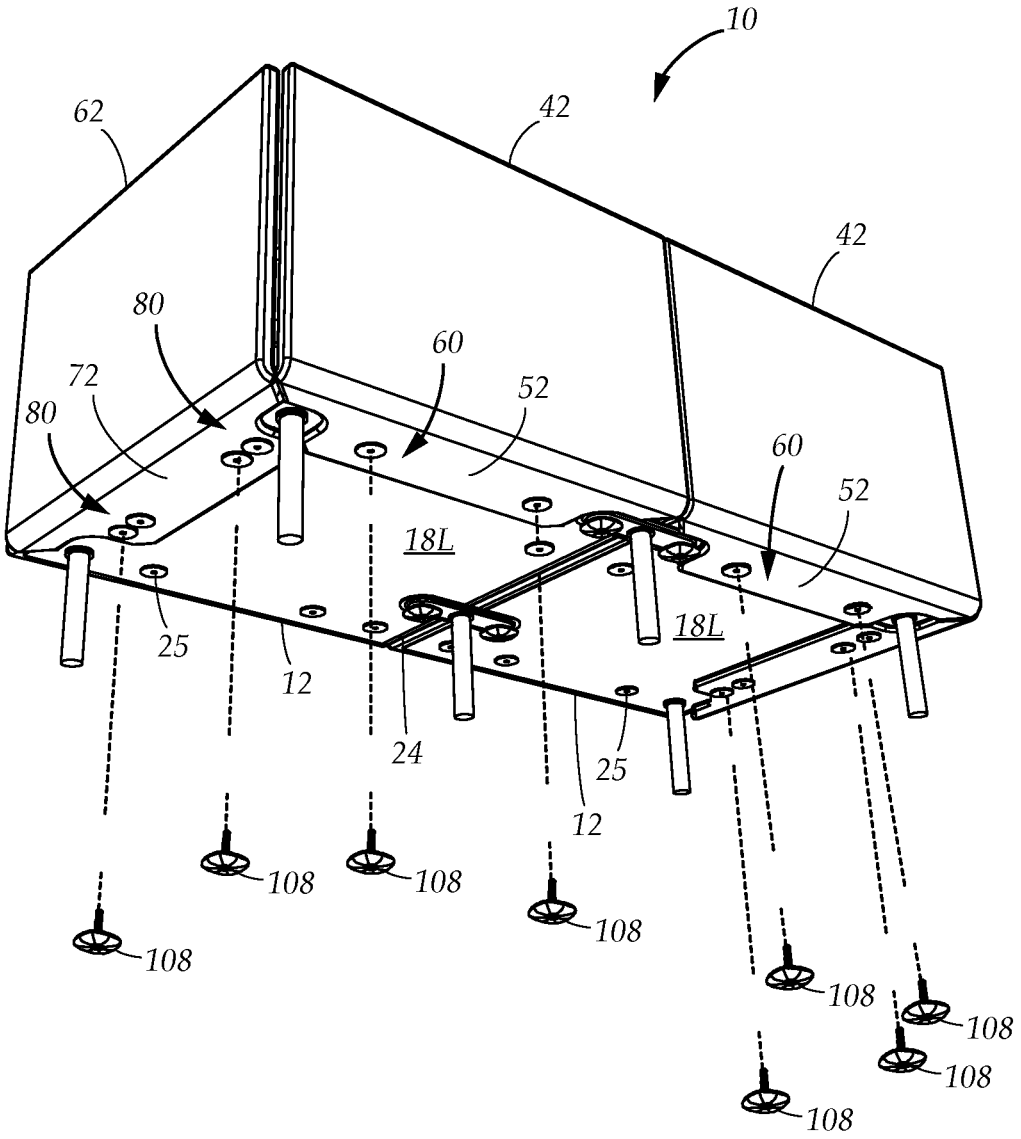
FIG. 6B is a diagrammatical exploded view showing the vertical and secondary vertical support structures attached to modular seating apparatus, ready to be secured to the base platforms using the plurality of fasteners, in accordance with an embodiment in the present disclosure.

Referring to FIG. 6B while also referring to FIG. 1D and FIGS. 2B-C, the fasteners 108 are adapted to secure other components, such as the connecting brackets 30, vertical support structures 42, and secondary vertical support structures 62, against the lower surfaces 18L of the base platforms 12. In a preferred embodiment, each fastener 108 has a head portion 109, and a fastening member 110 which projects perpendicularly therefrom and is adapted to interlock with the attachment points 25. In a preferred embodiment, the fastening member 110 has an interlocking means comprising a fastener threaded portion 110T which is adapted to engage with the threaded bore 25B of each attachment point 25. Each vertical support structure 42 has a horizontal attachment bracket 52 with a plurality of attachment bracket channels 60 which allow the fastening members 110 of the fasteners 108 to pass therethrough. The vertical support structure 42 is attached to one of the base platforms 12 by positioning the horizontal attachment bracket 52 against the lower surface 18L of the base platform 12, aligning the attachment bracket channels 60 with the attachment points 25, and inserting the fasteners 108 through the attachment bracket channels 60 to engage with the aligned attachment points 25. The horizontal attachment bracket 52 is securely held against the lower surface 18L of the base platform 12 by the head portion 109 of each of the fasteners 108 engaged thereto. In a preferred embodiment, the fasteners 108 may be turned by hand to interlock with the attachment points 25, thus allowing the modular seating apparatus 10 to be assembled without the use of tools.

Figure 6C:
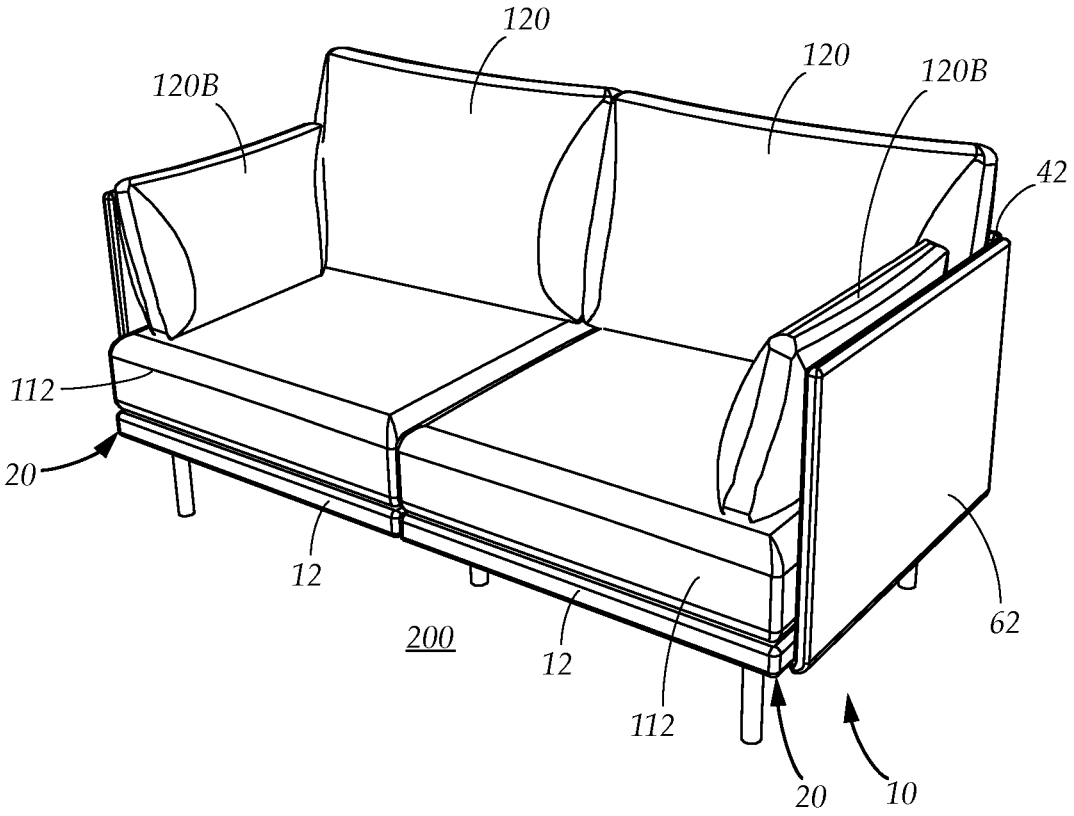
FIG. 6C is a diagrammatical perspective view of the modular seating apparatus positioned upon a horizontal surface, with the vertical support structures configured as backrests, and the secondary vertical support structures configured as armrests, in accordance with an example embodiment in the present disclosure.
Figure 7A:
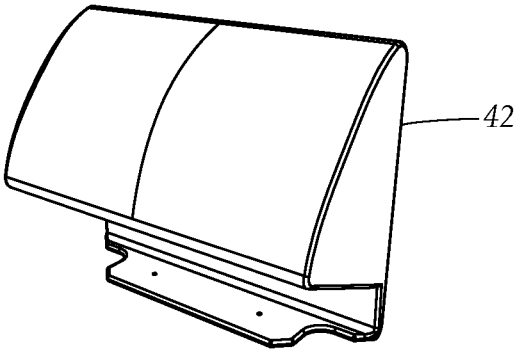
FIG. 7A is a diagrammatical perspective view of one of the vertical support structures with an integrated cushion, in accordance with an embodiment in the present disclosure.
Figure 7B:
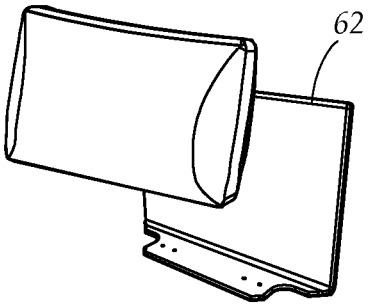
FIG. 7B is a diagrammatical perspective view of one of the secondary vertical support structures with a separate cushion, in accordance with an embodiment in the present disclosure.
Figure 7C:
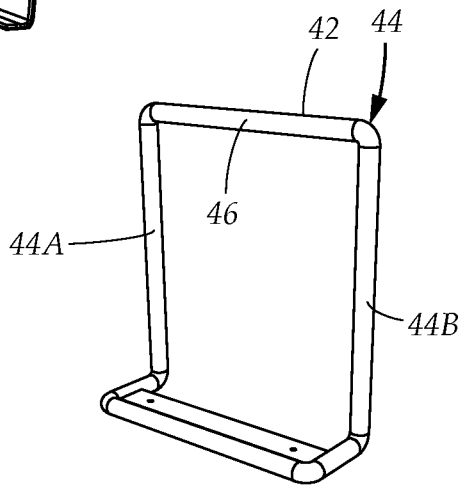
FIG. 7C is a diagrammatical perspective view of one of the vertical supporting structures formed as an open frame of tubular members, in accordance with an embodiment in the present disclosure.

Referring to FIGS. 2A-C while also referring to FIG. 6C, the connecting brackets 30 are adapted to securely link two of the base platforms 12 which are aligned along adjoining sides 14 such that the lower surfaces 18L of the adjoining base platforms 12 are coplanar. The adjoining base platforms 12 are then linked together using one or more of the connecting brackets 30. In a preferred embodiment, each connecting bracket 30 has an upper surface 36A, a lower surface 36B, and a first attachment channel 40A and a second attachment channel 40B which pass between the upper and lower surfaces 36A, 36B. In one embodiment, each connecting bracket 30 is formed from metal, wood, plastic, or other material having sufficient strength to withstand the weight of the persons seated upon the base platforms 12. The first and second attachment channels 40A, 40B are adapted to allow the fastening members 110 to pass therethrough. Two adjoining base platforms 12 are linked together by one of the connecting brackets 30, by placing the upper surface 36A of the connecting bracket 30 against the lower surfaces 18L of the adjoining base platforms 12 while aligning the first attachment channel 40A with one of the attachment points 25 of one of the base platforms 12 and the second alignment channel 40B with one of the attachment points 25 of the other adjoining base platform 12. Fasteners 108 are then passed through the first and second alignment channels 40A, 40B to engage with the attachment points aligned therewith. The connecting bracket is securely held against the lower surface 18L of the base platform 12 by the head portion 109 of each of the fasteners 108 engaged thereto.

In a preferred embodiment, at least one of the connecting brackets 30 has an inner attachment channel 38 which is positioned centrally between, and is colinear with, the first and second attachment channels 40A, 40B. The inner attachment channel 38 passes through the upper and lower surfaces 36A, 36B of the connecting bracket 30, and has an interlocking means which is adapted to engage with the attachment protrusions 107 of the support legs 104. When the connecting bracket 30 is secured to two adjoining base platforms 12, the inner attachment channel 38 is colinear with an adjoining line 24 which runs between the adjacent sides 14 of the two adjoined base platforms 12.

In a preferred embodiment, the inner attachment channel 38 has a threaded surface 38T which is adapted to threadably engage with the threaded portion 107T of the attachment protrusions 110, thus allowing one of the support legs 104 to be attached directly to the connecting bracket 30 to form a shared support leg 104B which reinforces the connecting bracket 30. Each shared support leg 104B is positioned centrally along the adjoining line 24 between the two base platforms 12 which are linked together by the connecting bracket 30 to which the shared support leg 104B is attached.

Downward forces exerted against the two adjoined base platforms 12 are transferred through the connecting bracket 30 to the shared support leg 104B to the horizontal surface 200, thus providing increased strength and stability to the assembled modular seating apparatus 10. In certain embodiments, a single shared support leg 104B with sufficient strength may be used to support two linked base platforms 12, without the use of any additional support legs 104.

Figure 2E:
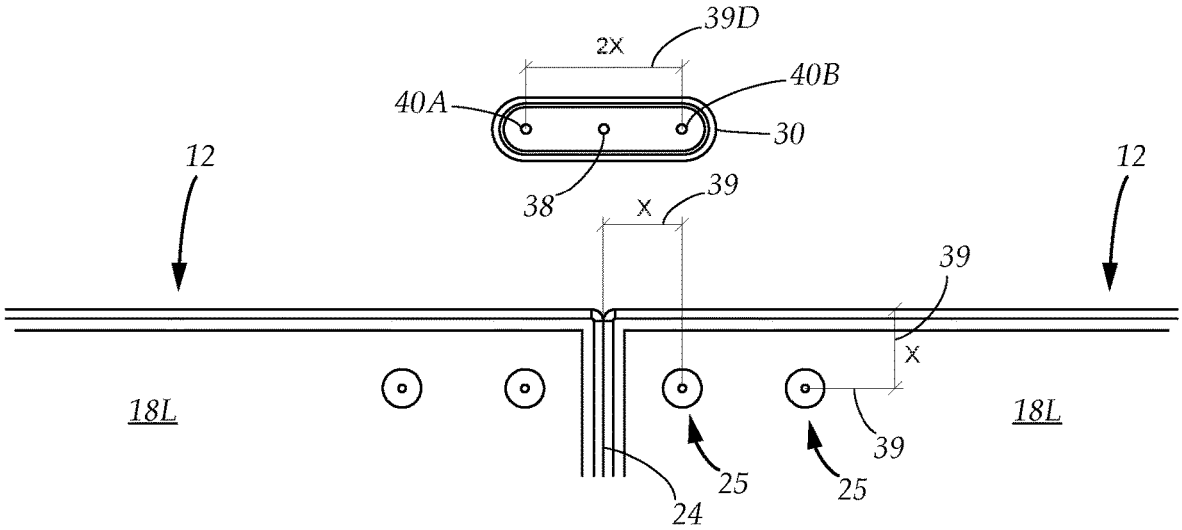
FIG. 2E is a diagrammatical bottom view of two of the base platforms and one of the connecting brackets, further depicting a channel interval distance which separates the attachment channels of the connecting bracket, and which separates the attachment points from the sides of the base platforms, in accordance with an embodiment in the present disclosure.
Figure 4A:
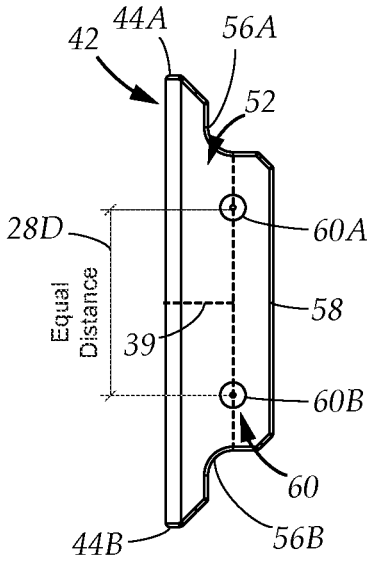
FIG. 4A is a diagrammatical bottom view of the horizontal attachment bracket, showing a plurality of attachment bracket channels, in accordance with an embodiment in the present disclosure.
Figure 4B:
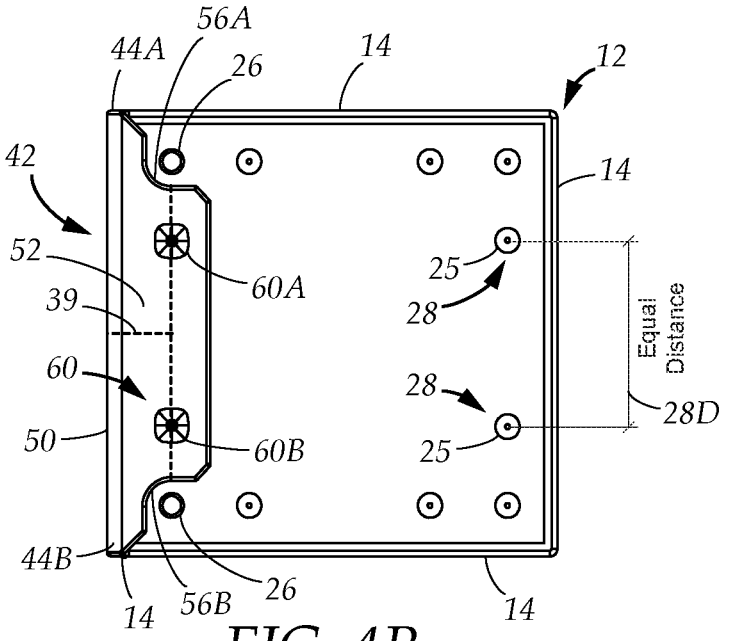
FIG. 4B is a diagrammatical bottom view of the vertical support structure attached to the lower surface of one of the base platforms, in accordance with an embodiment in the present disclosure.

Returning to FIG. 1A while also referring to FIG. 2E and FIG. 4B, in a preferred embodiment, the attachment points 25 on each base platform 12 are disposed according to a uniform arrangement across each side 14, thus allowing the various components to be attached to the base platforms 12 in a consistent manner independent of the orientation of the base platforms 12. The inner attachment channel 38 of the connecting bracket 30 is separated from the first and second attachment channels 40A, 40B by a channel interval distance 30, while the first and second attachment channels 40A, 40B are separated by a distance 39D equal to twice the channel interval distance 39.

In a preferred embodiment, each of the attachment points 25 is positioned proximate to one of the sides 14 of the base platform 12, and is separated from the side 14 closest to the attachment point 25 by the channel interval distance 39. The channel interval distance 39 ensures that multiple attachment points 25 are positioned proximate to each side 14 in a colinear arrangement.

In a preferred embodiment, the at least one attachment point 25 of each base platform 12 further comprises a colinear pair 28 positioned proximate to and parallel with each of the four sides 14, resulting in four colinear pairs 28 for each base platform 12. Each colinear pair 28 comprises a pair of intermediate attachment points including a first intermediate attachment point 28A and a second intermediate attachment point 28B. The first and second intermediate attachment points 28A, 28B are separated by an attachment point interval distance 28D.

In some embodiments, the attachment points 25 of each base platform may further comprise a plurality of shared attachment points 26. Each base platform 12 is rectangular and has four corners 20, and each shared attachment point 26 is positioned proximate to one of the corners 20. Each shared attachment point 26 is therefore colinear with two of the colinear pairs 28 of the base platform 12, and is further separated from two of the sides 14 by the channel interval distance 39.

Referring to FIG. 1A, FIG. 2C, and FIG. 2E, the uniform arrangement of the attachment points 25 allows corresponding colinear pairs 28 and shared attachment points 26 of adjoining base platforms 12 to align across the adjoining line 24 to form aligned sets. In one example, a first base platform 12A and an additional base platform 12N are adjoined, with the second longitudinal side 16B of the first base platform 12A positioned adjacent to the first longitudinal side 16A of the additional base platform 12N. The first and second lateral sides 14A, 14B of the adjoining base platforms are also in alignment. The first and second intermediate attachment points 28A, 28B proximate to the second longitudinal side 16B of the first base platform 12A are aligned with the corresponding first and second attachment points 28A, 28B proximate to the first longitudinal side 16A of the additional base platform 12N. Similarly, the shared attachment points 26 of the adjoining base platforms 12 proximate to and astride the adjoining line are also in alignment.

Every attachment point 25 is separated from the side 14 nearest thereto by the channel interval distance 39, and each corresponding aligned set of attachment points 25 is separated across the adjoining line 24 by a distance 39D equal to twice the channel interval distance 39, further matching the distance between the first and second attachment points 40A, 40B of the connecting brackets 30. This allows two adjoining base platforms 12 to be linked by attaching one of the connecting brackets 30 to one of the aligned sets across the adjoining line 24, further allowing the inner attachment channel 38 to be disposed collinearly with the adjoining line 24.

In the example depicted, two connecting brackets 30 are used to link the first base platform 12A to the additional base platform 12N. One connecting bracket 30 is positioned transverse to the adjoining line 24, with the first and second attachment channels 40A, 40B aligned with an aligned set formed by the first intermediate attachment points 28A of the two adjoining base platforms 12. A second connecting bracket 30 is also positioned transverse to the adjoining line 24, with the first and second attachment channels 40A, 40B aligned with an aligned set formed by the shared attachment points 26 proximate to the second lateral sides of the two adjoining base platforms 12.

Both connecting brackets 30 are secured to the base platforms 12 by fasteners 108 which pass through the connecting brackets 30 to engage with the attachment points 25 aligned therewith.

Referring to FIG. 2C along with FIG. 2D, a plurality of support legs 104 are attached to the two adjoined base platforms 12 to ensure that the modular seating apparatus 10 is sufficiently supported. In the example depicted, a shared support leg 104B is attached to the inner attachment channel 38 of each of the two connecting brackets 30 linking the adjoined base platforms 12. Additional support legs 104 are attached directly to the lower surfaces 18L of each of the base platforms 12 as directly-attached support legs 104A via the shared attachment points 26 proximate the first longitudinal side 16A of the first base platform 12A, and the second longitudinal side 16B of the additional base platform 12N.

Note that the example configuration depicted is not limiting, as the connecting brackets 30 may be attached to any aligned set across the adjoining line 24, and the directly attached support legs 104A may be attached to any of the attachment points 25 not already interlocked with one of the fasteners 108.

Figure 3A:
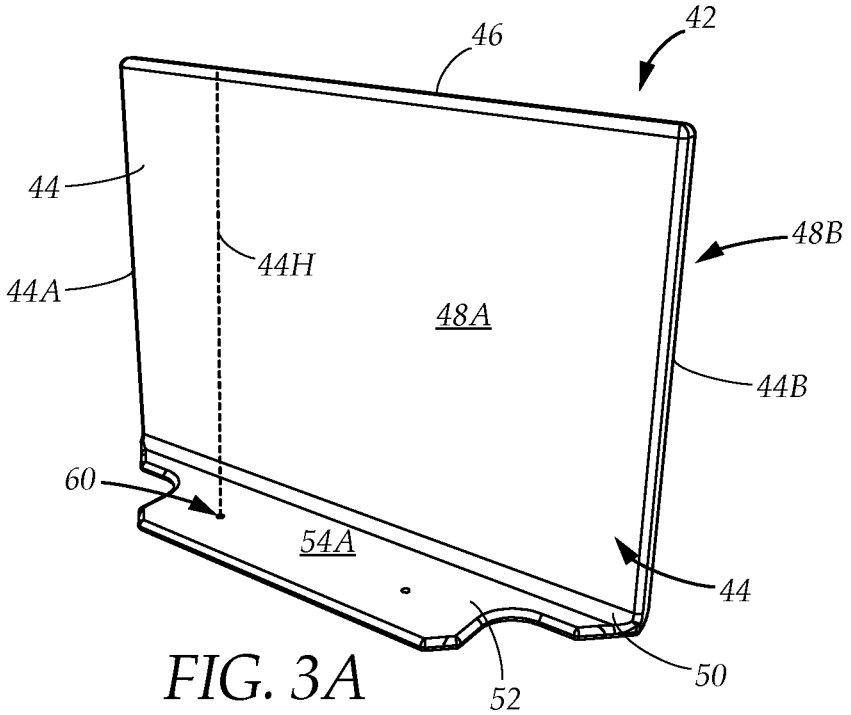
FIG. 3A is a diagrammatical perspective view of a vertical support channel, in accordance with an embodiment in the present disclosure.
Figure 3B:
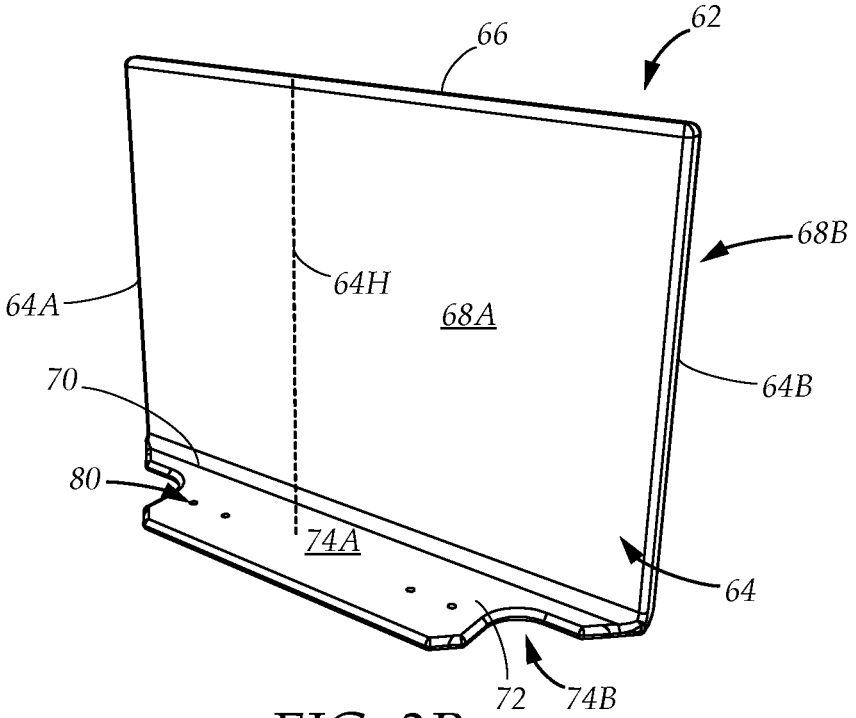
FIG. 3B is a diagrammatical perspective view of a secondary vertical support channel, in accordance with an embodiment in the present disclosure.
Figure 3C:
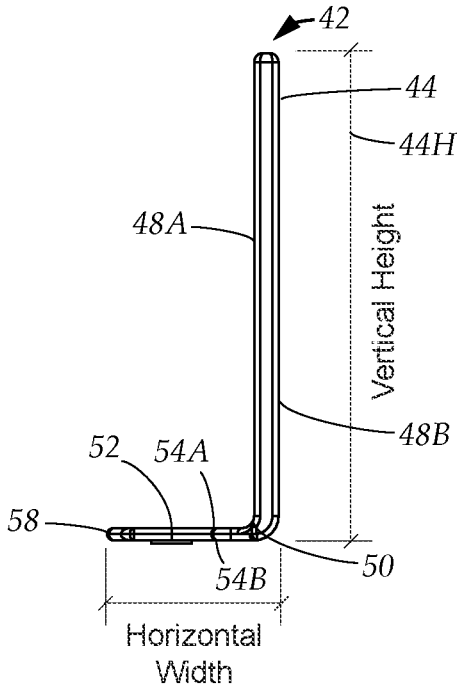
FIG. 3C is a diagrammatical side view of the vertical support channel, showing a supporting portion extending upwardly from a horizontal attachment bracket, in accordance with an embodiment in the present disclosure.

Turning to FIG. 3A-C while also referring to FIG. 6A, the vertical support structures 42 and secondary vertical support structures 62 are adapted to function as backrests or armrests for supporting the person seated upon the base platform 12. Each vertical support structure 42 comprises a horizontal attachment bracket 52 and a supporting portion 44 which extends angularly away from the horizontal attachment bracket 52. In a preferred embodiment, the horizontal attachment bracket 52 is substantially planar, and has an upper face 54A, a lower face 54B, and a plurality of attachment bracket channels passing between the upper and lower faces 54A, 54B. The supporting portion 44 is joined to the horizontal attachment bracket 52 along an upward bent portion 50. The supporting portion 44 has an upper side 46, which extends upwardly away from the horizontal attachment bracket 52 and the upward bent portion 50. In one embodiment, the supporting portion 44 is substantially planar, and has a first side 44A and a second side 44B which extend between the upper side 46 of the supporting portion 44 and the upward bent portion 50. The supporting portion 44 may also have an inner face 68A which faces towards the horizontal attachment bracket 52, and an outer face 68B disposed opposite the inner face 68A. The supporting portion 44 has a supporting portion height 44H which may be measured from the upward bent portion 50 to the upper side 46 of the supporting portion 44.

Referring to FIGS. 4A-B and FIGS. 6A-B while continuing to refer to FIG. 3A-C, each vertical support structure 42 is attached to one of the base platforms 12 by securing the attachment bracket upper face 54A of the horizontal attachment bracket 52 against the lower surface 18L of the base platform 12. The attachment bracket channels 60 are separated from the upward bent portion 50 by the channel interval distance 39. The attachment bracket channels 60 are aligned with one of the colinear pairs 28 of attachment points 25, and the horizontal attachment bracket 52 is secured via fasteners 108. The attachment bracket channels 60 comprise a first attachment bracket channel 60A and a second attachment bracket channel 60B which are colinear and arranged in parallel with the upward bent portion 50. The first and second attachment bracket channels 60A, 60B are separated by the attachment point interval distance 28D, allowing the vertical support structure 42 to be attached to any of the colinear pairs 28 along any of the sides 14 of the base platform 12. The upward bent portion 50 extends outwardly away from the base platform 12 and projects upwardly from the horizontal attachment bracket 52 to curve around the side 14, allowing the supporting portion 44 to extend upwardly away from the base platform 12.

Referring to FIGS. 4A-B while also referring to FIG. 3A, in one embodiment, the horizontal attachment bracket 52 is substantially planar, and has an attachment bracket front edge 58 which extends away from the upward bent portion 50. The attachment bracket channels 60 are positioned between the attachment bracket front edge 58 and the upward bent portion 50. The horizontal attachment bracket 52 may also have an attachment bracket first side 56A and an attachment bracket second side 56B which extend from the attachment bracket front edge towards the first side 44A and the second side 44B of the supporting portion 44 respectively. In one embodiment, the supporting portion 44 has a width as measured between the first side 44A and the second side 44B which equals the width of one of the sides 14 of the base platform 12. The attachment bracket first and second sides 44A, 44B may be curved inwardly, thus preventing the horizontal attachment bracket 52 from obstructing the shared attachment points 26 of the base platform 12.

Referring to FIGS. 3A-C and FIGS. 6A-B, the secondary vertical support structures 62 are configured similarly to the vertical support structures 42. Each secondary vertical support structure 62 has a secondary horizontal attachment bracket 72 with an upper face 74A and a lower face 74B, and a plurality of secondary attachment bracket channels 80 which pass through the secondary horizontal attachment bracket 72. The secondary attachment bracket channels 80 allow the secondary horizontal attachment bracket 72 to be attached to the lower surface 18L of one of the base platforms 12 using the fasteners 108. The secondary vertical support structure 62 has a secondary supporting portion 64 which is connected to the secondary horizontal attachment bracket 72 by an upward bent portion 70. The secondary supporting portion 64 extends upwardly away from the secondary horizontal attachment bracket 72. In a preferred embodiment, the secondary supporting portion 64 is substantially planar, and has an upper side 66, and a first side 64A and a second side 64B which extend between the upper side 66 and the upward bent portion 70. The secondary supporting portion 64 has a secondary supporting portion height 64H which may be measured from the upward bent portion 70 to the upper side 66 of the secondary supporting portion 64.

Figure 5A:
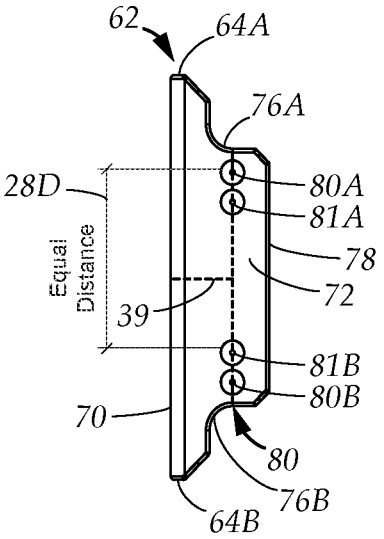
FIG. 5A is a diagrammatical bottom view of the secondary vertical support structure showing a secondary horizontal attachment bracket with a plurality of secondary attachment bracket channels, in accordance with an embodiment in the present disclosure.

Referring to FIG. 5A while also referring to FIGS. 6A-B, in one embodiment, the secondary vertical support structures 62 function as armrests, and may be attached along a side 14 of a base platform to position the secondary support structure 62 perpendicularly in relation to one or more of the vertical support structures 42. For example, one of the vertical support structures 42 may be attached along the second lateral side 14B of the base platform 12 to serve as a backrest, while one of the secondary vertical support structures 62 may be attached along the second longitudinal side 16B of the base platform 12 to serve as an armrest.

Figure 5B:
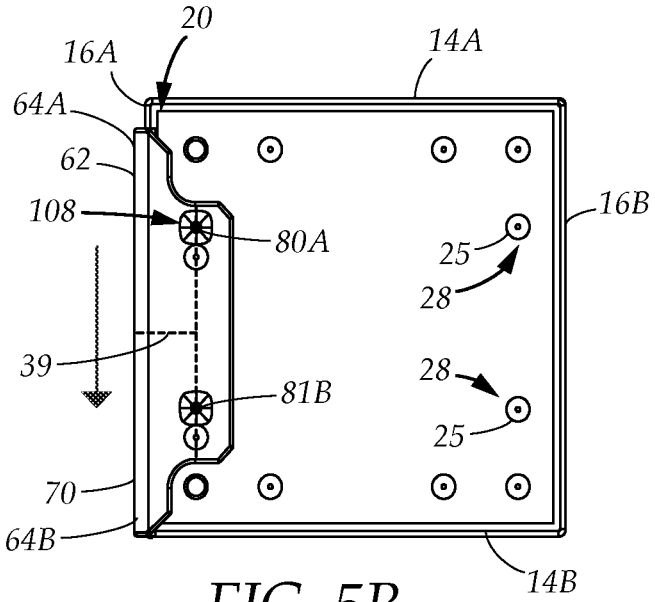
FIG. 5B is a diagrammatical bottom view of the secondary vertical support structure attached to the lower surface of one of the base platforms, further showing a second side of the secondary vertical support structure aligned with one of the two sides of the base platform between which the secondary vertical support structure extends, in accordance with an embodiment in the present disclosure.
Figure 5C:
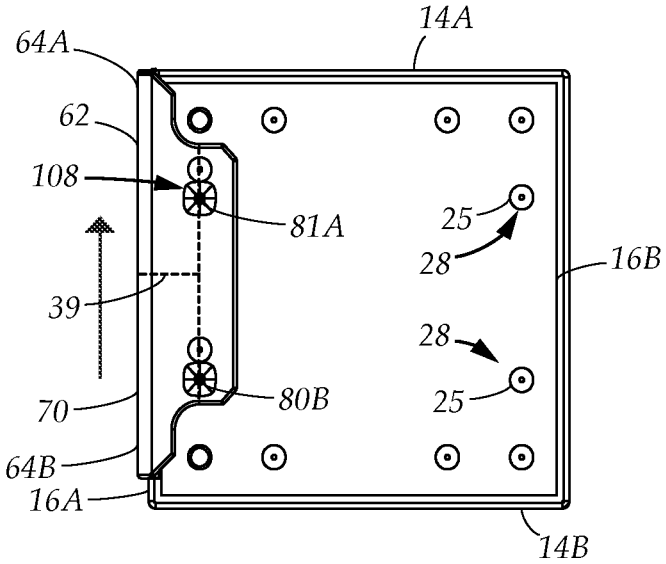
FIG. 5C is a diagrammatical bottom view of the secondary vertical support structure attached to the lower surface of one of the base platforms, further showing a first side of the secondary vertical support structure aligned with one of the two sides of the base platform between which the secondary vertical support structure extends, in accordance with an embodiment in the present disclosure.

Referring to FIGS. 5A-C while also referring to FIG. 3B and FIGS. 6A-C, in a preferred embodiment, the secondary supporting portion 64 has a width as measured between the first side 64A and the second side 64B which is shorter than the width of the sides 14 of the base platforms 12. The secondary supporting portion 64 extends between two of the sides 14 of the base platform 12 to which the secondary vertical support structure 64 is attached, the first and second sides 64A, 64B are adapted to be placed in alternating alignment with one of the two said sides 14.

For example, the secondary vertical support structure 62 may be attached to one of the base platforms 12 along the first longitudinal side 16A. The secondary support portion 64 extends between the first and second lateral sides 14A, 14B with the first and second sides 64A, 64B oriented towards the first lateral side 14A and the second lateral side 14B respectively. The second side 64B of the second supporting portion 64 may be placed in alignment with the second lateral side 14B of the base platform 12, which allows one of the corners 20 of the base platform 12 at the intersection of the first lateral side 14A and the first longitudinal side 16A to extend past the first side 64A of the secondary supporting portion 64. Alternatively, the first side 64A of the second supporting portion 64 may be placed in alignment with the first lateral side 14A of the base platform 12, which allows one of the corners 20 of the base platform 12 at the intersection of the second lateral side 14B and the first longitudinal side 16A to extend past the first side 64A of the secondary supporting portion 64.

Referring to FIG. 3B and FIGS. 5A-C while also referring to FIG. 1A, the alternating alignment of the secondary supporting portion 64 is facilitated by the arrangement of the secondary attachment bracket channels 80. In a preferred embodiment, the secondary attachment bracket channels 80 are arranged in a colinear sequence comprising a first outer attachment bracket channel 80A, a first inner attachment bracket channel 81A, a second inner attachment bracket channel 81B, and a second outer attachment bracket channel 80B. The secondary attachment bracket channels 80 are separated from the upward bent portion 70 by the channel interval distance 39. The first outer attachment bracket channel 80A is oriented towards the first side 64A of the secondary supporting portion 64, while the second outer attachment bracket channel 80B is oriented towards the second side 64B. The first outer attachment bracket channel 80A and the second inner attachment bracket channel 81B are separated by the attachment point interval distance 28D, while the first inner attachment bracket channel 81A and the second outer attachment bracket channel 80B are also separated by the attachment point interval distance 28D.

The second side 64A may be placed in alignment with the second lateral side 14B by aligning the first outer attachment bracket channel 80A and the second inner attachment bracket channel 81B with the colinear pair 28 of attachment points 25 proximate to the first longitudinal side 16A of the base platform 12. Alternatively, the first side 64B may be placed in alignment with the first lateral side 14A by aligning the first inner attachment bracket channel 81A and the second outer attachment bracket channel 80B with said colinear pair 28 of attachment points 25.

Referring to FIGS. 3A-B, FIG. 6C and FIGS. 7A-C, the supporting portions 44 and the secondary supporting portions 64 may be configured as substantially solid panels, or as open frames with a central void space. For example, in one embodiment, the supporting portion 44 may be configured with tubular members forming each of the upper side 46, and the first and second sides 44A, 44B.

In certain embodiments, the modular seating apparatus 10 may include one or more supporting portion cushions 120 placed against the inner face 48A of the supporting portions 44, and one or more secondary supporting portion cushions 120B placed against the inner face 68A of the secondary supporting portions 64. Alternatively, in certain embodiments, one or more of the supporting portions 44 and/or the secondary supporting portions 64 may have an integrated cushion.

Figure 8A:
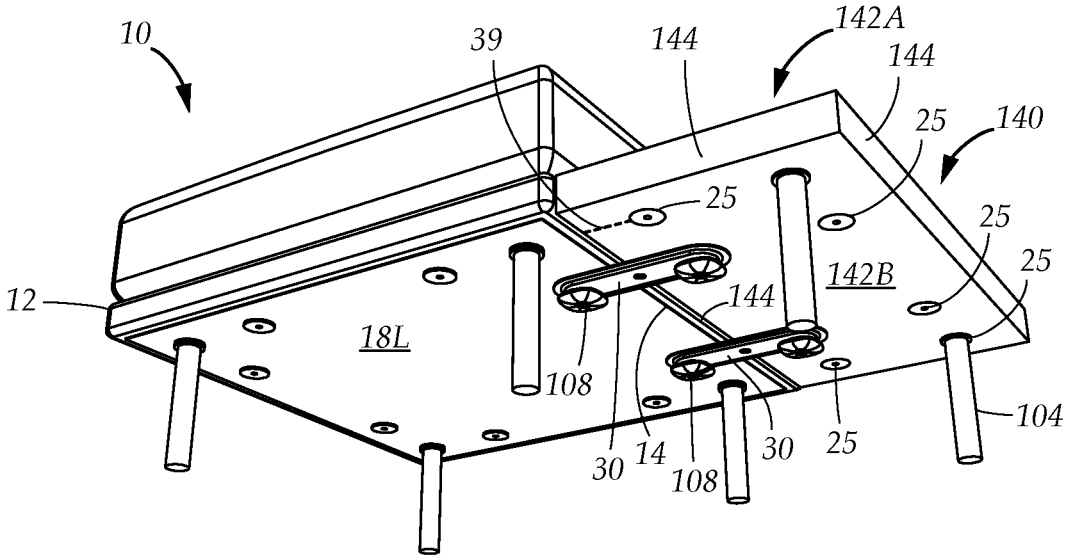
FIG. 8A is a diagrammatical perspective view of an ancillary platform attached to one of the base platforms, in accordance with an embodiment in the present disclosure.

Turning to FIG. 8A, the modular seating apparatus 10 may further comprise an ancillary platform 140 adapted to be attached to one of the base platforms 12. The ancillary platform 140 has a plurality of ancillary platform sides 144, an ancillary platform supporting surface 142A for supporting one or more objects placed thereon, and a lower surface 142B disposed opposite the ancillary platform supporting surface 142A. One or more attachment points 25 functionally identical to the attachment points 25 of the base platforms 12 are positioned on the lower surface 142B of the ancillary platform 140. The attachment points 25 are separated from one of the ancillary platform sides 144 by the channel interval distance 39. The ancillary platform 140 is attached to one of the base platforms 12 by aligning one of the ancillary platform sides 144 with one of the sides 14 of the base platform, positioning one of the connecting brackets 30 therebetween, and securing the connecting bracket 30 to the lower surface 18L of the base platform 12 and to the lower surface 142B of the ancillary platform 140 using the fasteners 108.

Figure 8B:
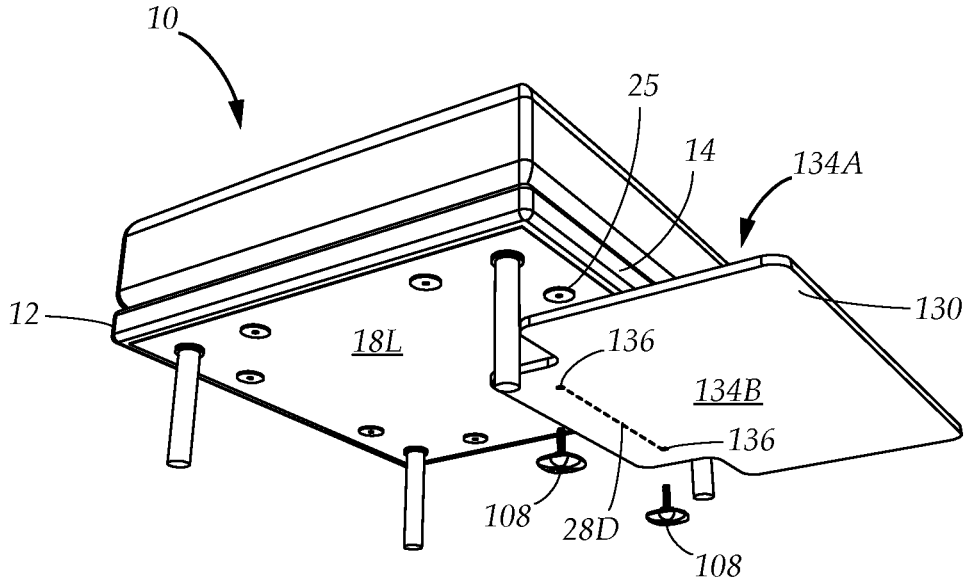
FIG. 8B is a diagrammatical perspective view of a horizontal panel aligned with the attachment points of one of the base platforms, in accordance with an embodiment in the present disclosure.
Figure 8C:
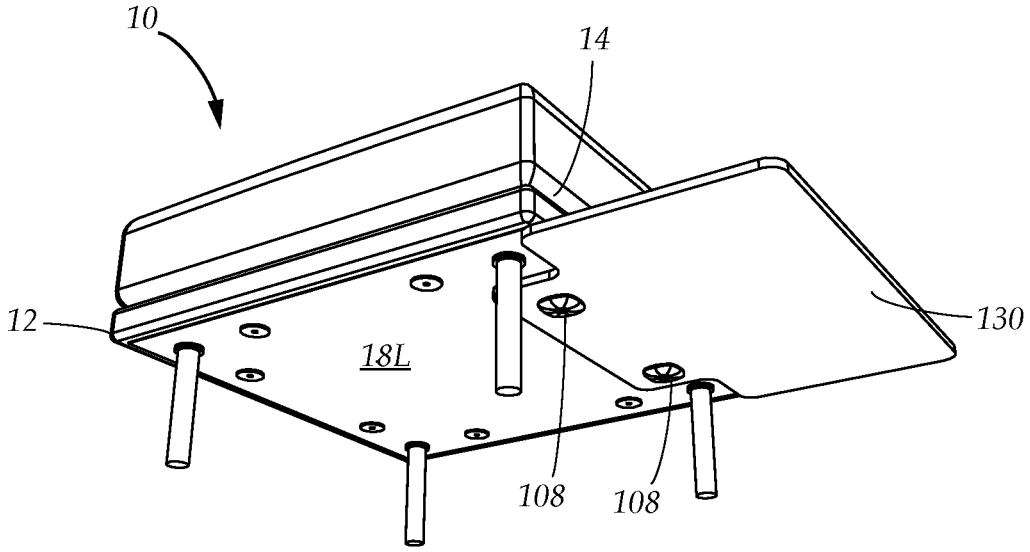
FIG. 8C is a diagrammatical perspective view of the horizontal panel attached to the base platform using two of the fasteners in accordance with an embodiment in the present disclosure.

Turning to FIGS. 8B-C while also referring to FIG. 1A, the modular seating apparatus may further comprise a horizontal panel 130. The horizontal panel 130 has an upper supporting surface 134A for supporting one or more objects placed thereon, a lower surface 134B, and a plurality of horizontal panel attachment channels 136 separated by the attachment point interval distance 28D. The horizontal panel 130 is adapted to be attached to the lower surface 18L of one of the base platforms 12 by passing fasteners 108 through each of the horizontal panel attachment channels 136 to engage with one of the colinear pairs 28 of attachment points 25 of the base platform 12.

Figure 9A:
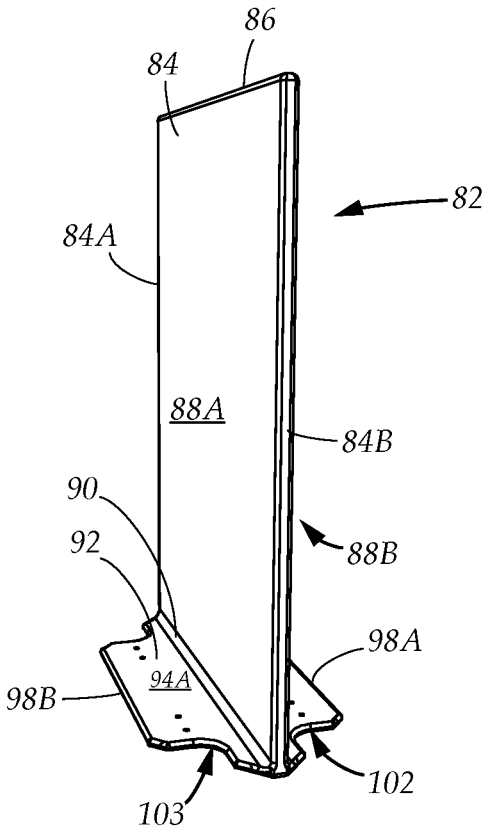
FIG. 9A is a diagrammatical perspective view of a connecting partition, in accordance with an embodiment in the present disclosure.
Figure 9B:
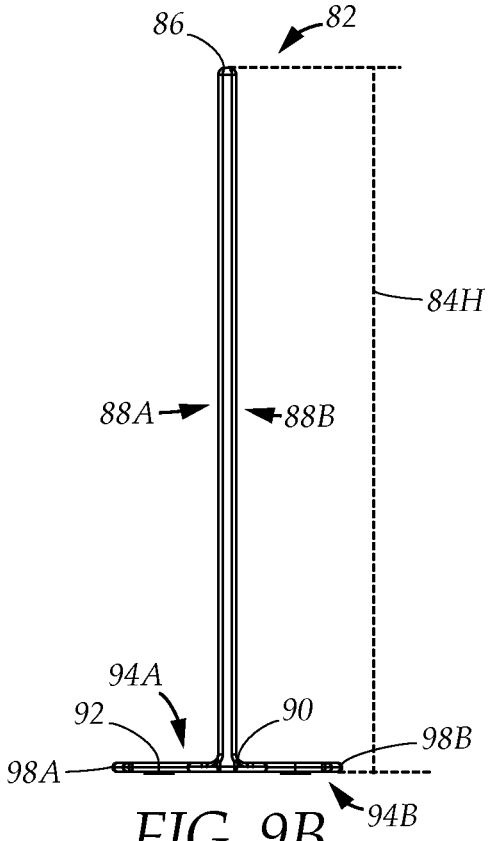
FIG. 9B is a diagrammatical side view of the connecting partition, showing a partition connecting bracket with a vertical planar portion, in accordance with an embodiment in the present disclosure.
Figure 9C:
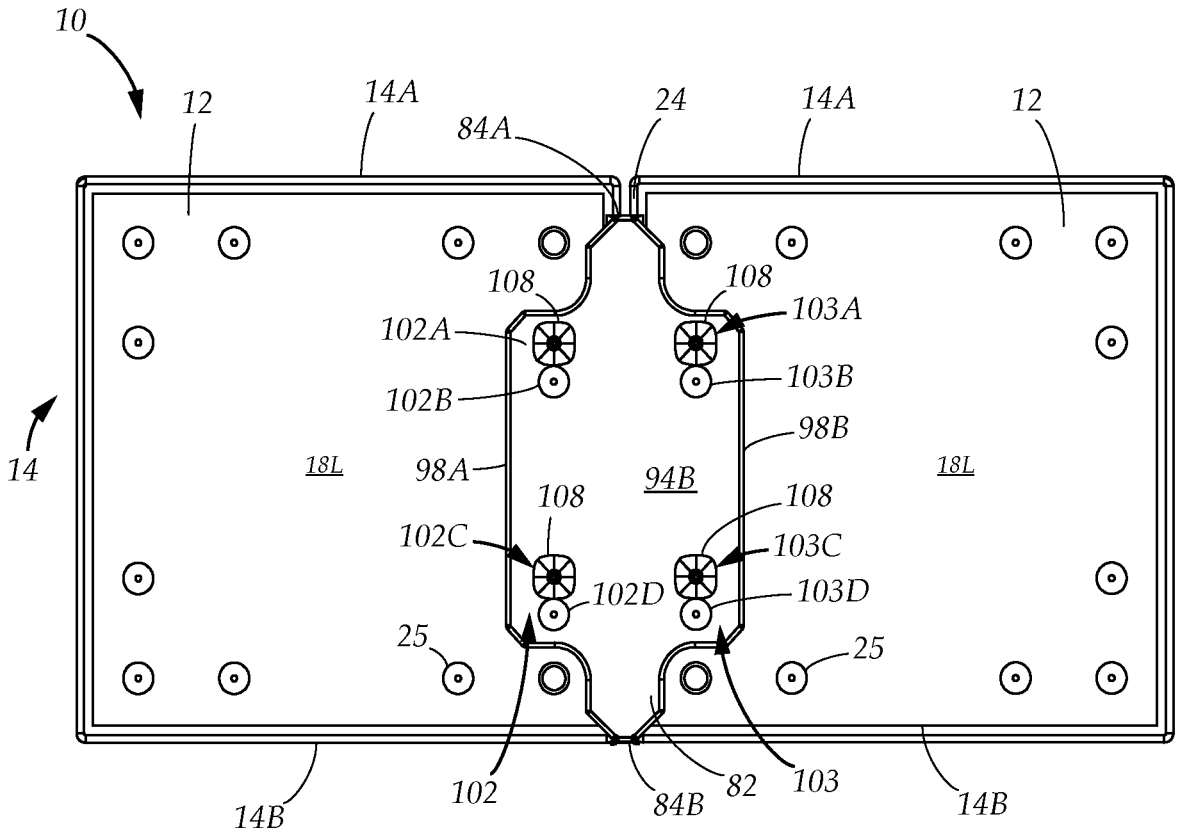
FIG. 9C is a diagrammatical bottom view of the connecting partition positioned between and linking together two of the base platforms which are adjoined, in accordance with an embodiment in the present disclosure.
Figure 10A:
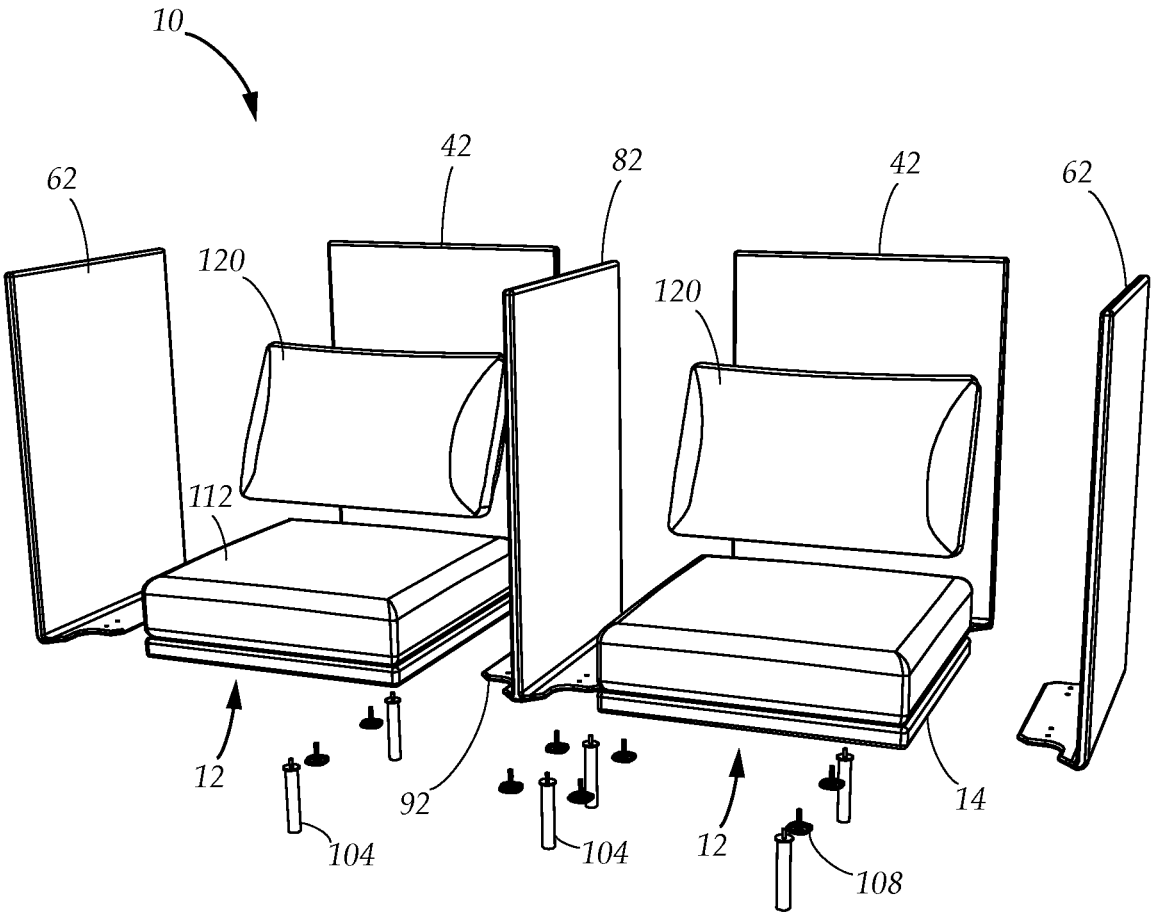
FIG. 10A is a diagrammatical exploded view of the modular seating apparatus with one of the connecting partitions positioned between two of the base platforms, in accordance with an embodiment in the present disclosure.

Turning to FIGS. 9A-C while also referring to FIG. 10A, the modular seating apparatus 10 may further comprise a connecting partition 82 adapted to both link two of the base platforms 12 together, and is further adapted to form a physical barrier which extends between the two adjoining base platforms 12. The connecting partition 82 has a partition connecting bracket 92 having an upper face 94A, a lower face 94B, and a vertical planar portion 84 which extends upwardly away from the upper face 94A of the partition connecting bracket 92. In one embodiment, the vertical planar portion 84 is connected to the partition connecting bracket 92 along a base portion 90, and has an upper side 86 and a first side 84A and a second side 84B which extend between the base portion 90 and the upper side 86. In one embodiment, the vertical planar portion 84 has a width, as measured between the first and second sides 84A, 84B, which is shorter than the sides 14 of the base platforms 12. The vertical planar portion 84 has a vertical planar portion height 84H which may be measured from the base portion 90 to the upper side 86 of the vertical planar portion 84H.

The partition connecting bracket 92 has a plurality of partition attachment channels 102 which extend between the upper and lower faces 94A, 94B, comprising at least one first partition attachment channel 102, and at least one second partition attachment channel 103. The upper face 94A of the partition connecting bracket 92 is placed in contact with the lower surfaces 18L of two adjoining base platforms 12, and is secured to attachment points 25 on both adjoining base platforms 12 via fasteners 108. The vertical planar portion 84 is positioned centrally between the first and second partition channel 102, 103, and extends upwardly through the adjoining line 24 between the two adjoining base platforms 12. In one embodiment, the partition connecting bracket 92 has a partition connecting bracket first side edge 98A and a partition connecting bracket second side edge 98B, and the base portion 90 of the vertical planar portion 84 extends centrally therebetween.

In one embodiment, the at least one first partition attachment channel 102 further comprises a colinear series of four first partition attachment channels 102A-D, while the at least one second partition attachment channel 103 further comprises a colinear series of four second partition attachment channels 103A-D.

Referring to FIGS. 5A-C and FIG. 1A while continuing to refer to FIG. 9A and FIG. 9C, the first and second partition attachment channels 102A-D, 103A-D are configured in a manner substantially similar to the secondary attachment bracket channels 80 of the secondary vertical support structures 62, thus allowing the first and second sides 84A, 84B of the vertical planar portion 84 to be placed in alternating alignment with one of the sides 14 between which the vertical planar portion 84 extends.

In one example, the vertical planar portion 84 extends between the first and second lateral edges 14A, 14B of two adjoining base platforms 12. By selectively aligning two of each of the four first partition attachment channels 102A-D and the four second attachment channels 103A-D with the colinear pairs 28 of attachment points 25 of the two adjoining base platforms 12 proximate to adjoining line 24, the vertical planar portion 84 may be positioned to allow either the first side 84A to align with the first lateral sides 14A of the base partitions 12, or the second side 84B to align with the second lateral sides 14B of the base partitions 12.

Figure 10B:
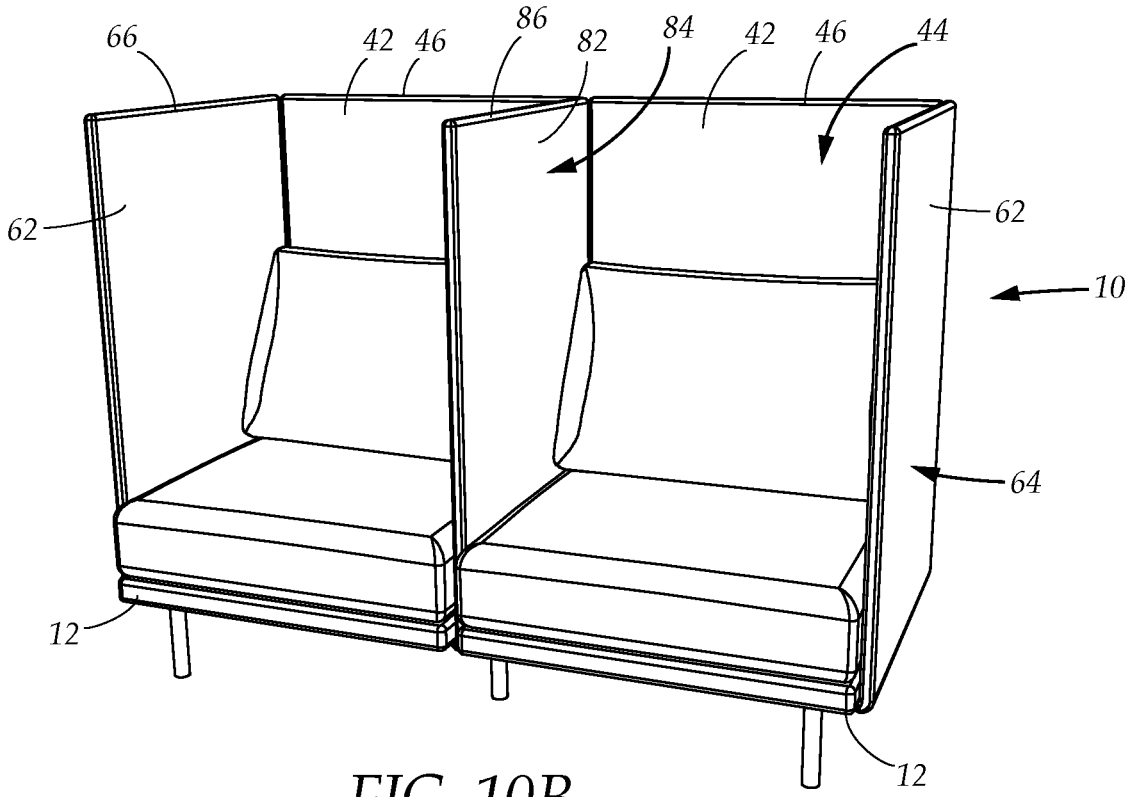
FIG. 10B is a diagrammatical perspective view of the modular seating apparatus, with the connecting partition configured as a privacy wall which divides the base platforms, in accordance with an embodiment in the present disclosure.

Referring to FIG. 10B while also referring to FIGS. 3A-B and FIG. 9B, in one embodiment, the vertical planar portion height 84H may be sufficiently long to allow the upper side 86 of the vertical planar portion 84 to extend upwardly above a person seated upon the base platform 12, thus allowing the connecting partition 82 to function as a privacy wall which separates the base platforms 12 of the modular seating apparatus 10. The supporting portion height 44H and the secondary supporting portion height 64H may be similarly extended such that the upper side 46 of the supporting portion 44, the upper side 66 of the secondary supporting portion 64, and the upper side 86 of the vertical planar portion 84 are horizontally aligned, thus forming a privacy booth around one of the base platforms 12.

Figure 12A:
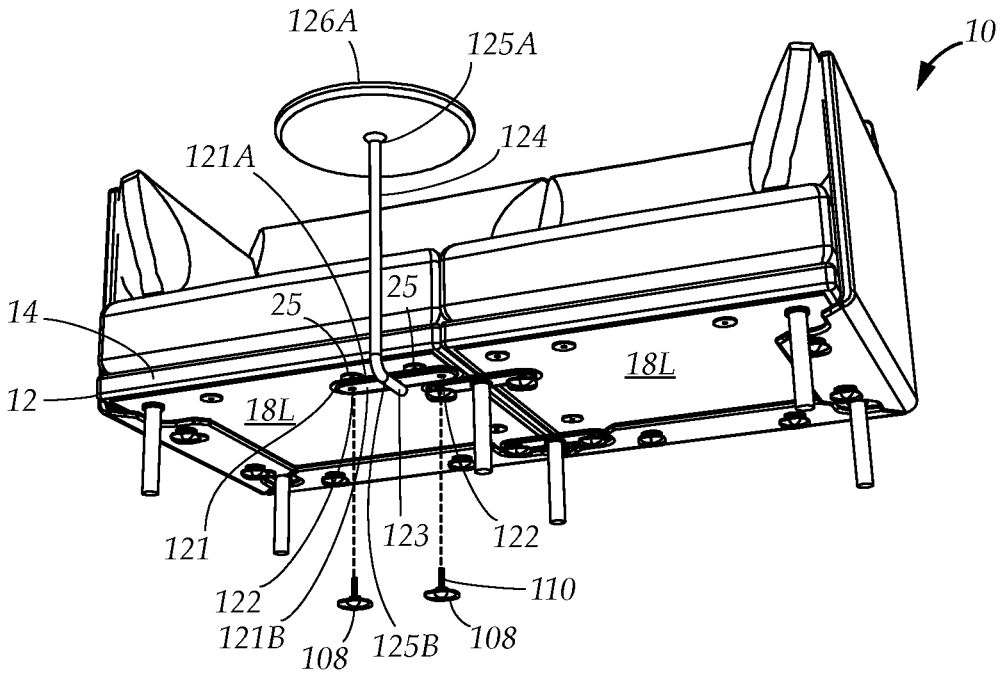
FIG. 12A is a diagrammatical perspective view of an accessory mounting bracket and accessory mounting member attached to the modular seating apparatus, in accordance with an embodiment in the present disclosure.
Figure 12B:
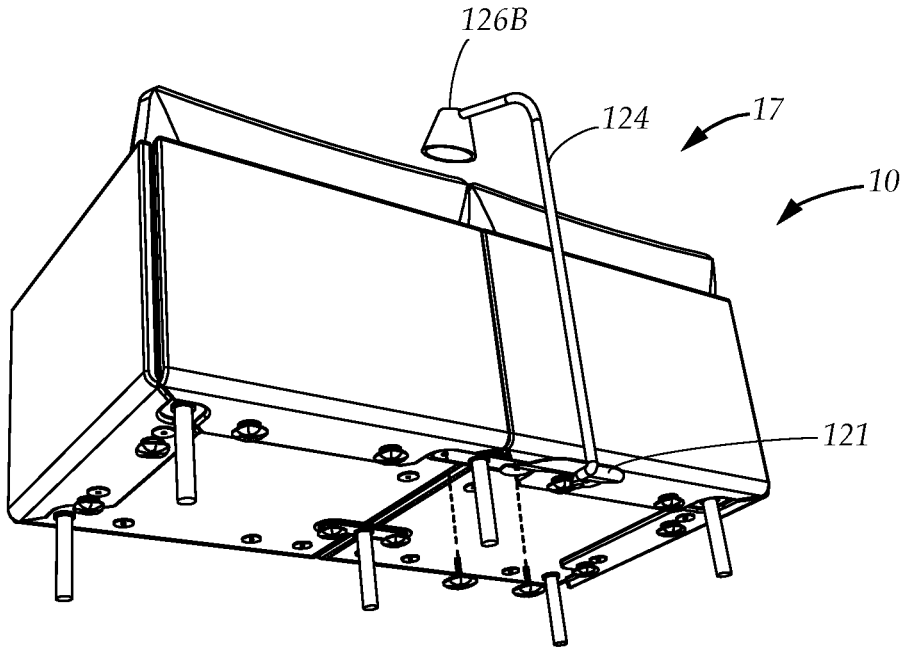
FIG. 12B is a diagrammatical perspective view of the modular seating apparatus with a lighting device attached to the accessory mounting bracket, in accordance with an embodiment in the present disclosure.

Turning to FIGS. 12A and 12B while also referring to FIG. 2E, the modular seating apparatus 10 may further comprise one or more accessory mounting brackets 121, and an accessory mounting member 124. The accessory mounting member 124 is adapted to support an accessory, such as a platform 126A for supporting small objects, a lighting device 126B, or other accessory which provides comfort or utility to one of the persons seated upon the modular seating apparatus 10.

Each accessory mounting bracket 121 comprises an accessory mounting bracket upper surface 121A, an accessory mounting bracket lower surface 121B, and a horizontal accessory bracket 123 positioned upon the accessory mounting bracket lower surface 121B. The accessory mounting bracket has a pair of accessory mounting bracket attachment channels 122 separated by a distance equal to double the channel interval distance 39D. The accessory mounting bracket 121 is adapted to be secured to the lower surface 18L of at least one of the base platforms 12 by positioning the accessory mounting bracket upper surface 121A in contact with the lower surface 18L of the base platform 12, and passing the fastening members 110 of two of the fasteners 108 through the accessory mounting bracket attachment channels 122 to interlock with two of the attachment points 25 of the base platforms.

The accessory mounting member 124 has a mounting member first end 125A, and a distally oriented mounting member second end 125B. The mounting member first end 125A is adapted to support the accessory, while the mounting member second end 125B is adapted to engage with the horizontal accessory bracket 123. In one embodiment, the accessory mounting member 124 may be configured as a bent tube, while the horizontal accessory bracket 123 may be a circular bracket which is adapted to engage with the tubular sectional shape of the mounting member second end 125B.

In a preferred embodiment, accessory mounting member 124 projects horizontally away from the accessory mounting bracket 121, and extends upwardly around one of the sides 14 of the base platform 12 to which the accessory mounting bracket 121 is attached.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a modular seating apparatus and a modular seating kit for the assembly thereof. The disclosure is illustrated by example in the drawing figures, and throughout the written description. It should be understood that numerous variations are possible, while adhering to the inventive concept. Such variations are contemplated as being a part of the present disclosure.

What is claimed is:

1. A method comprising:

providing a base platform, a first leg, a second leg, and a support structure to an end user, wherein the base platform includes a shared attachment point, a first attachment point, a second attachment point, a third attachment point, and a fourth attachment point, wherein the first attachment point and the second attachment point are spaced apart from each other thereby forming a first colinear pair, wherein the third attachment point and the fourth attachment point are spaced apart from each other thereby forming a second colinear pair, wherein the first colinear pair and the second colinear pair oppose each other while being colinear with the shared attachment point, wherein the support structure is L-shaped as defined via a base portion and a supporting portion; and instructing the end user to secure (a) the base portion to the base platform at the first attachment point and the second attachment point and (b) the first leg and the second leg to the base platform such that (c) the base portion extends between the first leg and the second leg, (d) the first colinear pair is disposed between the first leg and the second leg, and (e) the supporting portion extends past the base platform away from the first leg and the second leg, wherein the first leg or the second leg is secured to the shared attachment point.

2. The method of claim 1, further comprising:

providing a cushion to the end user; and instructing the end user to position the cushion on the base platform such that the cushion extends over the first colinear pair and the second colinear pair.

3. The method of claim 1, wherein the base platform has a rectangular shape defined via a first side, a second side, a third side, and a fourth side, wherein the first colinear pair is disposed on the first side, wherein the second colinear pair is disposed on the second side.

4. The method of claim 3, wherein the base platform includes a fifth attachment point and a sixth attachment point, wherein the fifth attachment point and the sixth attachment point are spaced apart from each other thereby forming a third colinear pair, wherein the third colinear pair is disposed on the third side, wherein the first colinear pair, the second colinear pair, and the third colinear pair define a U-shape.

5. The method of claim 4, wherein the shared attachment point is a first shared attachment point, wherein the base platform includes a second shared attachment point, a seventh attachment point, and an eighth attachment point, wherein the seventh attachment point and the eighth attachment point are spaced apart from each other thereby forming a fourth colinear pair, wherein the fourth colinear pair is disposed on the fourth side, wherein the second shared attachment point is colinear with the first colinear pair and the fourth colinear pair, wherein the first side directly opposes the third side, wherein the second side directly opposes the fourth side.

6. The method of claim 1, wherein the base platform is a first base platform, and further comprising:

providing a second base platform and a bracket to the end user; and instructing the end user to connect the bracket to (f) the first base platform at the third attachment point or the fourth attachment point and (g) the second base platform such that (h) the bracket spans between the first base platform and the second base platform and (i) the first base platform and the second base platform participate in forming a modular sofa.

7. The method of claim 6, further comprising:

providing a third leg to the end user; and instructing the end user to secure the third leg to the bracket.

8. The method of claim 1, wherein the support structure is a first support structure, and further comprising:

providing a second support structure to the end user, wherein the second support structure is L-shaped; and instructing the end user to secure the second support structure at the third attachment point and the fourth attachment point such that the second support structure extends past the base platform while opposing the supporting portion.

9. The method of claim 1, further comprising:

providing a cushion to the end user; and instructing the end user to position the cushion on the support structure such that the cushion contacts the base portion and the supporting portion.

10. The method of claim 1, further comprising:

providing an ancillary platform and a bracket to the end user; and instructing the end user to connect the bracket to (f) the base platform at the third attachment point or the fourth attachment point and (g) the ancillary platform such that (h) the bracket spans between the base platform and the ancillary platform.

11. The method of claim 1, further comprising:

providing a panel to the end user; and instructing the end user to connect the panel to the base platform at the third attachment point or the fourth attachment point.

12. The method of claim 1, wherein the support structure is a single L-shape structure.

13. The method of claim 1, wherein the support structure is a dual L-shaped structure such that the support structure is T-shaped.

14. The method of claim 13, wherein the base platform is a first base platform, and further comprising:

providing a second base platform to the end user; and instructing the end user to secure the dual L-shaped structure to the second base platform such that the supporting portion extends between the first base platform and the second base platform past the second base platform.

15. The method of claim 1, further comprising:

providing a bracket, a member, and an accessory to the end user; and instructing the end user to secure the bracket to the base platform, the member to the bracket, and the accessory to the member.

16. The method of claim 15, wherein the accessory is a platform.

17. The method of claim 15, wherein the accessory is a lighting unit.

18. A system comprising:

a modular furniture including a base platform, a first leg, a second leg, and a support structure, wherein the base platform includes a shared attachment point, a first attachment point, a second attachment point, a third attachment point, and a fourth attachment point, wherein the first attachment point and the second attachment point are spaced apart from each other thereby forming a first colinear pair, wherein the third attachment point and the fourth attachment point are spaced apart from each other thereby forming a second colinear pair, wherein the first colinear pair and the second colinear pair oppose each other while being colinear with the shared attachment point, wherein the support structure is L-shaped as defined via a base portion and a supporting portion, wherein the base portion is configured to be secured to the base platform at the first attachment point and the second attachment point, and the first leg and the second leg are configured to be secured to the base platform such that the base portion extends between the first leg and the second leg, the first colinear pair is disposed between the first leg and the second leg, and the supporting portion extends past the base platform away from the first leg and the second leg, wherein the first leg or the second leg is configured to be secured to the shared attachment point.

19. A method comprising:

accessing a base platform, a first leg, a second leg, and a support structure, wherein the base platform includes a shared attachment point, a first attachment point, a second attachment point, a third attachment point, and a fourth attachment point, wherein the first attachment point and the second attachment point are spaced apart from each other thereby forming a first colinear pair, wherein the third attachment point and the fourth attachment point are spaced apart from each other thereby forming a second colinear pair, wherein the first colinear pair and the second colinear pair oppose each other while being colinear with the shared attachment point, wherein the support structure is L-shaped as defined via a base portion and a supporting portion; and securing (a) the base portion to the base platform at the first attachment point and the second attachment point and (b) the first leg and the second leg to the base platform such that (c) the base portion extends between the first leg and the second leg, (d) the first colinear pair is disposed between the first leg and the second leg, and (e) the supporting portion extends past the base platform away from the first leg and the second leg, wherein the first leg or the second leg is secured to the shared attachment point.

20. A method comprising:

sending a modular furniture to an end user, wherein the modular furniture includes a base platform, a first leg, a second leg, and a support structure, wherein the base platform includes a shared attachment point, a first attachment point, a second attachment point, a third attachment point, and a fourth attachment point, wherein the first attachment point and the second attachment point are spaced apart from each other thereby forming a first colinear pair, wherein the third attachment point and the fourth attachment point are spaced apart from each other thereby forming a second colinear pair, wherein the first colinear pair and the second colinear pair oppose each other while being colinear with the shared attachment point, wherein the support structure is L-shaped as defined via a base portion and a supporting portion, wherein the base portion is configured to be secured to the base platform at the first attachment point and the second attachment point, and the first leg and the second leg are configured to be secured to the base platform such that the base portion extends between the first leg and the second leg, the first colinear pair is disposed between the first leg and the second leg, and the supporting portion extends past the base platform away from the first leg and the second leg, wherein the first leg or the second leg is configured to be secured to the shared attachment point.

* * * * *